United States Patent [19]

Yagi et al.

[11] Patent Number: 4,686,176

[45] Date of Patent: Aug. 11, 1987

[54] MULTILAYER MULTI-COLOR PHOTOGRAPHIC MATERIAL

[75] Inventors: Toshihiko Yagi; Katsumasa Yamazaki; Kenji Michiue; Yoshiharu Mochizuki; Sohei Goto, all of Hino, Japan

[73] Assignee: Konishiroku Photo Industry Co., Ltd., Tokyo, Japan

[21] Appl. No.: 778,320

[22] Filed: Sep. 20, 1985

[30] Foreign Application Priority Data

Sep. 25, 1984 [JP] Japan ..... 59-200980

[51] Int. Cl.[4] ..... G03C 1/46; G03C 1/02

[52] U.S. Cl. ..... 430/506; 430/567; 430/569

[58] Field of Search ..... 430/509, 567, 569

[56] References Cited

U.S. PATENT DOCUMENTS

| | | | |
|---|---|---|---|
| 4,349,622 | 9/1982 | Koitabashi et al. | 430/567 |
| 4,399,215 | 8/1983 | Wey | 430/567 |
| 14,433,048 | 2/1984 | Solberg et al. | 430/567 X |
| 4,434,226 | 2/1984 | Wilgus et al. | 430/569 X |
| 4,435,501 | 3/1984 | Maskasky | 430/567 X |
| 4,463,087 | 7/1984 | Maskasky | 430/569 X |
| 4,490,458 | 12/1984 | House | 430/567 X |
| 4,504,570 | 3/1985 | Evans et al. | 430/550 X |

OTHER PUBLICATIONS

Daubendiek, "AgI Precipitations: Effects of pAg on Crystal Growth (PB), III-23", Papers from the 1978 International Congress of Photographic Science, Rochester, New York, pp. 140-143, 1978.

J. S. Wey and R. W. Strong, Photographic Science & Engineering, vol. 21, 14 (1977), "Growth Mechanism of AgBr Crystals in Gelatin Solution".

A. Kumai and Y. Minagawa, Journal of Photographic Science, vol. 18, 131(1970), "Photographic Properties of Polyethylene Oxide II., Effect of PEO on the Growth Habit of Silver Halide Grains".

Byerley and Hirsch, "Dispersion of Metastable High Temperature Cubic Silver Iodide", Journal of Photographic Science, vol. 18, 1970, pp. 53-59.

*Primary Examiner*—John E. Kittle
*Assistant Examiner*—Mukund J. Shah
*Attorney, Agent, or Firm*—Frishauf, Holtz, Goodman & Woodward

[57] ABSTRACT

In a light-sensitive silver halide photographic material having blue-sensitive, green-sensitive and red-sensitive photosensitive layers on a support and being capable of forming a multi-color image, the improvement wherein at least one of said photosensitive layers comprises a high sensitivity layer and a low sensitivity layer; at least one of said high sensitivity layers contains flat plate silver halide grains with an average aspect ratio of 5:1 or higher; and at least one of said low sensitivity layer contains an emulsion comprising silver halide grains which are substantially mono-dispersed.

21 Claims, No Drawings

MULTILAYER MULTI-COLOR PHOTOGRAPHIC MATERIAL

BACKGROUND OF THE INVENTION

This invention relates to a light-sensitive silver halide color photographic material, particularly to a light-sensitive silver halide photographic material suitable for photography improved in color reproduction and sharpness.

In recent years, higher sensitization and small formatting of silver halide color nega film have been progressed, and it has been strongly desired to have a light-sensitive color nega photographic material having high sensitivity and excellent image quality.

For such a demand, a large number of studies have been made primarily about improvement of silver halide emulsions.

For example, Japanese Unexamined Patent Publication Nos. 113930/1983, 113934/1983 and 119350/1984 disclose light-sensitive multi-layer color photographic materials improved in graininess, sharpness and color reproducibility by use of an emulsion containing silver halide grains shaped in flat plates with an aspect ratio of 8:1 or higher in a high sensitivity layer.

Also, Japanese Unexamined Patent Publication Nos. 93344/1982, 145135/1979 and 151944/1982 disclose improved techniques for sharpness and color reproducibility by use of a diffusible DIR.

Here, the above techniques may be classified into improved techniques for sharpness and color reproducibility by the optical effect due to the flat plane grains and by the developing effect due to the DIR compounds.

However, as can be seen in Japanese Unexamined Patent Publication No. 129849/1984, when using a silver halide emulsion shaped in flat plates, the effect due to DIR compound cannot fully be exhibited and the improvement observed only in a limited scope of compounds was not to a practically satisfactory level.

Such problems are particularly marked in the case of epitaxial type flat plate grains as disclosed in Japanese Unexamined Patent Publication Nos. 108526/1983, 119350/1984 and 133540/1984, and it would be desirable to have improved techniques therefor.

SUMMARY OF THE INVENTION

An object of the present invention is to provide a light-sensitive silver halide color photographic material which is high in sensitivity and good in color reproducibility and sharpness.

The object of the present invention can be accomplished by a light-sensitive silver halide photographic material having blue-sensitive, green-sensitive and red-sensitive photosensitive layers on a support and capable of forming a multi-color image, in which at least one of said photosensitive layers comprises a high sensitivity layer and a low sensitivity layer; at least one of said high sensitivity layers contains silver halide grains with an average aspect ratio of 5:1 or higher; and at least one of said low sensitivity layers contains an emulsion comprising silver halide grains which are substantially mono-dispersed.

DESCRIPTION OF THE PREFERRED EMBODIMENTS

The light-sensitive silver halide photographic material of the present invention has a multi-layer structure in which emulsion layers containing binders and silver halide grains for recording separately blue, green and red light separately are overlayed, and at least one layer of said emulsion layers comprises a high sensitivity layer and a low sensitivity layer. Particularly practical layer constitutions may include the following:

(1) BH/BL/GH/GL/RH/RL/S
(2) BH/BL/GH/RH/GL/RL/S
(3) BH/BL/GH/GM/GL/RH/RM/RL/S
(4) BH/GH/RH/BL/GL/RL/S
(5) BH/BL/GH/RH/GM/GL/RM/RL/S

Here, B represents a blue-sensitive layer, G a green-sensitive layer, R a red-sensitive layer, H a high sensitivity layer, M a medium sensitivity layer, L a low sensitivity layer, S a support, with description of non-photosensitive layers such as protective layer, filter layer, intermediate layer, halation preventive layer, subbing layer, etc. being omitted. Among them, a particularly preferred layer constitution is (1) or (2).

In the light-sensitive silver halide photographic material of the present invention, at least one of the highest sensitivity layers contains a silver halide emulsion with an average aspect ratio of silver halide grains of 5:1 or higher. The aspect ratio refers to the ratio of diameter to thickness of a grain. Here, the diameter of a silver halide grain refers to the diameter of a circle equal in area to the projected area of a grain. The silver halide grain (flat plate silver halide grain) as specified by the above aspect ratio to be used in the present invention has an aspect ratio of preferably from 5 or more to 100 or more, more preferably from 5 to 50, particularly preferably from 5 to 20.

In the present invention, the diameter of the flate plate silver halide grain is 0.5 to 15.0 μm, preferably 1.0 to 10.0 μm.

In the layer containing the flat plate silver halide grains of the present invention, said flat plate grains should exist preferably in an amount of 40% by weight or more, particularly 60% by weight or more, based on the total amount of silver halide grains in said layer.

When the flat plate grains to be used in the present invention are not subjected to sensitization by epitaxial growth of a different kind of silver salt on its surface, the halogen composition of the flat plate silver halide grain should preferably be silver bromide and silver iodobromide, more preferably a silver iodobromide with a content of silver iodide of 0 to 15 mol %.

The particularly preferred content of silver iodide in the above silver iodobromide is 4 to 10 mol %.

Also, it is preferred to have an inner structure within the grain such that the flat plate silver iodobromide grains have a first and a second principal parallel planes opposed to each other and a central region spreading between said two principal planes, further an outer region spreading between said two principal planes and being displaced in at least one transverse direction (the direction parallel to the principal planes), with different iodide contents between said central region and the outer region. Among the above inner structures, particularly preferred is one having an inner grain structure in which the iodide content in the outer region is lower than that in the central region. Also, the outer region may preferably have a composition distribution so that it may form a loop in the lateral direction to surround the central region. The iodide content at the boundary layer between the central region and the outer region may be changed so as to have a sharp boundary interface, or alternatively it may be changed continuously with no distinct boundary.

As the method for preparation of flat plate grains having such a halogen composition distribution within the grain, reference may be made to Japanese Unexamined Patent Publication Nos. 15428/1977, 118823/1979, 113927/1983 and 99433/1984.

The flat plate silver halide grains according to the present invention may be either poly-dispersed or mono-dispersed, but preferably mono-dispersed. Grains having preferable mono-dispersability are ones having a fluctuation coefficient of the grain size distribution of 25% or less (this grain size is defined as the diameter of the circumference). As the method for preparation of an emulsion comprising mono-dispersed flat plate grains, there may be employed the method as disclosed in Japanese Unexamined Patent Publication Nos. 39027/1976 and 211143/1979.

Also, as the preferable method for preparing an emulsion comprising mono-dispersed flat plate grains, it is possible to employ a method in which nucleic grains comprising multiple twin crystals are aged in the presence of a silver halide solvent to prepare seed masses comprising mono-dispersed spherical grains and thereafter growing these masses. As a further preferable method, during growth of the flat plate grains, a tetrazaindene compound is present to enhance the ratio of flat plate grains and also improve mono-dispersibility.

When the flat plate silver halide grains to be used in the present invention are sensitized by epitaxial growth of a different kind of silver halide on the surface, the flat plate crystal as described above may be used as such as the host crystal, or a flat plate grain comprising pure silver iodide may be used as the host crystal. As the silver halide to be used for epitatxial growth, there may be employed silver bromide, silver chloride or silver chlorobromide, particularly preferably silver bromide. The silver halide grains obtained by the epitaxial growth may contain silver iodide in the amount of 5 mole % or less.

In the flat plate epitaxial type silver halide to be used in the present invention, the proportion of the epitaxial crystals should preferably 5 to 30 mol %, particularly 10 to 20 mol % based on the total silver halide mols.

The epitaxial growth in the epitaxial type flat plate silver halide to be used in the present invention should preferably be performed selectively at a restricted site on the silver halide surface, for example, the site of edge, corner, circular portion, etc. Such silver halide emulsions can be prepared by use of the methods as disclosed in Japanese Unexamined Patent Publications Nos. 108526/1983, 119350/1984 and 133540/1984.

The silver halide grains which are substantially monodispersed of the present invention to be used in the low sensitivity layer may comprise either regular crystals such as cubic, tetradecahedral or octahedral crystals or twin crystals, or mixtures thereof, but preferably regular crystals.

In the present invention, the mono-dispersed silver grains refer to those in which the weight of the silver halide included within the grain size range of ±20% of the average grain size comprises 60% or more of the total weight of silver halide grains, preferably 70% or more, particularly 80% or more.

Here, the average grain size $\bar{r}$ is defined as the grain size $r_i$ when the the product $n_i \times r_i^3$ of the frequency $n_i$ of the grain having a grain size $r_i$ and $r_i^3$ (effective figures: 3, the minimum figure being rounded to nearest whole number).

The grain size as herein mentioned refers to its diameter in the case of a spherical silver halide grain, or the diameter of a circle image with the same area as the projected image, in the case of a grain having a shape other than spherical.

The grain size can be measured by, for example, photographing said grain by an electron microscopoe to a magnification of ×10,000 or ×50,000, and measuring the diameter of the grain or the area during projection on its print (the number of measured grains is determined equally as 1000 or more).

The low sensitivity layer containing the mono-dispersed silver halide emulsion according to the present invention can contain other mono-dispersed or poly-dispersed emulsions. For example, it means that those having a plurality of modes in the grain size distribution curve are also included in the present invention. In such a case, the grain size distribution of silver halide grains may be such that the weight of silver halide grains included within the range of ±20% of $\bar{r}$ is 50% or more, more preferably 60% or more, particularly preferably 70% or more, based on the total weight of silver halide grains.

The silver halide grains to be used in the low sensitivity layer of the present invention should preferably be of the core/shell type emulsion. An emulsion comprising regular crystals of core/shell type may be obtained according to the method, in which an aqueous water soluble silver salt solution and an aqueous water soluble halide solution are added into a gelatin solution contining seed grains of regular crystals according to the double jet method under control of pAg and pH. In determination of the addition rate, reference may be made to Japanese Unexamined Patent Publications Nos. 48521/1979 and 49938/1983.

An emulsion comprising twin crystals of core/shell type may be prepared by referring to, for example, Japanese Unexamined Patent publication No. 118823/1979. These methods are specific in that silver iodide nuclei are formed at the initial stage, followed by causing the conversion reaction to occur by addition of water soluble silver salt and water soluble halide solution to form cores comprising silver iodobromide.

The twin crystal emulsion of core/shell type can also be obtained by aging a multiple twin crystal nucleus emulsion in the presence of a silver halide solvent to give a mono-dispersed spherical seed emulsion, which is in turn grown according to the double jet method.

The silver halide grains for the low sensitivity layer which are preferably used in the present invention comprise a grain structure constituted of two or more layers with different silver iodide contents, in which the silver iodide content in the outermost layer (shell portion) of said two or more layers should preferably be lower than the silver iodide content in the inner layer (core portion). The silver iodide content in the core portion may be 5 to 40 mol %,. preferably 6 to 30 mol %, more preferably 7 to 20 mol %. The silver iodide content in the shell portion may be less than 5 mol %, preferably 0.5 to 4.0 mol %.

In the present invention, the difference in content of the silver iodide in the silver halide grains between the core portion and the shell portion may be such as to form a sharp boundary therebetween or to be changed continuously with no distinct boundary. As the method for changing continuously the halogen composition at the core/shell boundary, there may be employed the method in which the composition of the halide solution to be added is gradually changed in the double jet method. A localized composition of silver iodide may also exist in the core portion and the shell portion.

Further, the proportion of the shell portion in the core/shell type silver halide grains may be 10 to 80%, preferably 15 to 70%, more preferably 20 to 60%.

The distribution of silver iodide in the above silver haide grains can be detected according to various physical measurment methods. For example, it can be examined also by measurement of luminescence at lower temperature, as disclosed in the Collected Gists of Lectures at Annual Meeting of 1981, Photographic Society of Japan.

In the present invention, the silver halide employed may be silver bromide, silver iodide or silver iodobromide, particularly preferably silver iodobromide, and a minute amount of silver chloride may also be present, provided that the photographic performance of the emulsion is not impaired thereby.

Also, by providing a hydroxytetrazaindene compound during growth of the grains of the mono-dispersed emulsion in the present invention, a highly mono-dispersed emulsion can be obtained.

The mono-dispersed silver halide grain for the low sensitivity layer according to the present invention should preferably have a different kind of silver halide epitaxially grown at the restricted site of its surface. Such silver halide grains can be obtained according to the methods as discloed in Japanese Unexamined Patent Publication Nos. 103725/1978, 133540/1984; European Patent 19917 (1980).

As the host crystal, there may be employed $\beta$-silver iodide, silver iodobromide consisting mainly of (111) plane and containing 6 to 40 mol % of silver iodide, more preferably silver iodobromide containing 7 to 30 mol % of AgI, particularly preferably silver iodobromide containing 8 to 15 mol % of AgI.

In the epitaxial type emulsion for the low sensitivity layer according to the present invention, the silver halide at the epitaxial growth portion can be a silver chloride, silver bromide or a silver iodobromide, but is preferably a silver iodobromide containing 0 to 5 mol % of silver iodide, particularly preferably a silver iodobromide containing 0.5 to 4 mol % of silver iodide.

In the epitaxial type emulsion for the low sensitivity layer according to the present invention, the proportion of the epitaxial crystal portion should preferably be 5 to 30 mol %, particularly preferably 10 to 20 mol % based on the total mole of silver halide.

The average grain sizes of the mono-dispersed emulsion for the low sensitivity layer in the present invention should preferably be 0.4 $\mu$m or more in view of color reproducibility and sharpness, more preferably 0.6 to 2.0 $\mu$m.

In the present invention, the mono-dispersed silver halide emulsion to be used in the low sensitivity layer may also be an emulsion comprising two or more kinds of emulsions with different average grain sizes, provided that they are 0.4 $\mu$m or higher, but it is particularly preferred that the emulsion consists of only one kind.

The reason why the developing effect is greatly influenced by the shape, average grain size, the grain size distribution, the halogen composition, etc. of the silver halide grains may be presumed that the above effect is determined from a delicate balance among the amount of the inhibitory substance released during development, its diffusibility, its inhibitory effect, adsorptive force onto silver halide grain surfaces and silver halide grain surface area.

In the light-sensitive color photographic material of the present invention, a compound capable of releasing a development inhibitor or its precursor (hereinafter called DIR compound) can be used. Preferable compounds may be represented by the following Formula [I].

$$A\text{-}(Z)_n \qquad \text{Formula [I]}$$

wherein A represents a coupling component capable of reacting with the oxidized product of a color developing agent; Z is a group which is bonded to the above coupling component and can be released through the reaction with the oxidized product of the color developing agent, representing the residual amount of the compound for releasing a development inhibitor or its precursor; and n represents an integer of 1 or 2.

As the coupling component represented by A in the above Formula [I] which can react with the oxidized product of a color developing agent, there may be included organic groups which form dyes through the reaction with the oxidized product of the color developing agent and organic groups which can react with the oxidized product of the color developing agent but do not form dyes.

When A is an organic group which can form a dye through the reaction with the oxidized product of a color developing agent, it can be, for example, a residual group of each of magenta, yellow and cyan couplers.

As the magenta coupler residual group, those represented by the following Formula [II] are particularly useful:

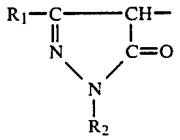

Formula [II]

wherein $R_1$ is an alkyl group selected from primary, secondary and tertiary groups (e.g. methyl, propyl, n-butyl, tert-butyl, hexyl, 2-hydroxyethyl, 2-phenylethyl, etc.), an aryl group, a heterocyclic residual group (e.g. 5- to 6-membered residual group containing nitrogen or oxygen as a hetero atom, more specifically quinolinyl, pyridyl, benzofuranyl, oxazolyl, etc.), an amino group (e.g. methylamino, diethylamino, dibutylamino, phenylamino, tolylamino, 4-(3-sulfobenzamino)anilino, 2-chloro-5-acylaminoanilino, 2-chloro-5-alkoxycarbonylanilino, 2-tolylfluoromethylphenylamino, etc.), a carbonamide group (e.g. ethylcarbonamide, alkylcarbonamide, arylcarbonamide, benzothiazolylcarbonamide, etc.), a sulfonamide (e.g. sulfonamide, heterocyclic sulfonamide, etc.), a ureido group (e.g. alkylureido, arylureido, heterocyclic ureido, etc.), an alkoxy group (e.g. methoxy, ethoxy, etc.) and others; $R_2$ is hyrogen atom, an aryl group (e.g. naphthyl, phenyl, 2,5-dichlorophenyl, 2,4,6-trichlorophenyl, 2-chloro-4,6-dimethylphenyl, 2,6-dichloro-4-methoxyphenyl, 4-methylphenyl, 4-acylaminophenyl, 4-alkylaminophenyl, 4-trichloromethylphenyl, 3,5-dibromophenyl, etc.), a heterocyclic group (e.g. a 5- and/or 6-membered ring containing nitrogen atom or oxygen atom as a hetero atom, more specifically benzofuranyl, naphthoxazolyl, quinolinyl, etc.) or an alkyl group (e.g. ethyl, benzyl, etc.).

As the yellow coupler residual groups, those represented by the following Formula [III] are useful.

Formula [III]

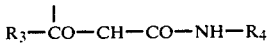

wherein $R_3$ is a primary, secondary or tertiary alkyl group having 1 to 18 carbon atoms (e.g. tert-butyl, 1,1-dimethylpropyl, etc.), or an aryl group (e.g. phenyl, naphthyl, alkoxyphenyl, 2-chloro-5-[γ-(2,4-di-t-amylphenoxy)butylamide]phenyl as a halophenyl, etc.); $R_4$ is an aryl group such as 2-chlorophenyl, 2-chloro-5-[(2,4-di-tert-amylphenoxy)acetamido]phenyl, 2-chloro-5-(4-methylphenylsulfonamido)phenyl, 2-methoxyphenyl, etc.

In the present invention, when A is a yellow coupler residual group represented by the Formula [III], $R_3$ should preferably be a tertiary alkyl group or an aryl group.

As the cyan coupler residual group, those represented by the following Formula [IV] or [V] are useful.

Formula [IV]

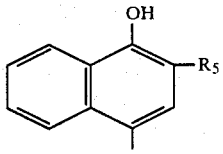

Formula [V]

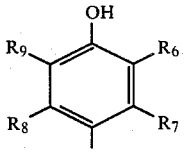

wherein $R_5$ is a substituent to be used for cyan coupler such as a carbamyl group (e.g. alkylcarbamyl, phenylcarbamyl, arylcarbamyl or heterocyclic carbamyl such as benzothiazolylcarbamyl, etc.), a sulfamyl group (e.g. alkylsulfamyl, phenylsulfamyl, arylsulfamoyl heterocyclic sulfamyl, etc.), an alkoxycarbonyl or an aryloxycarbonyl; $R_6$ is an alkyl group, an aryl group, a heterocyclic residual group, an amino group (amino, alkylamino, arylamino, etc.), a carbonamide group (e.g. alkylcarbonamide, arylcarbonamide, etc.), a sulfonamide group, a sulfamyl group (alkylsulfamyl, arylsulfamyl, etc.) or a carbamyl group; $R_7$, $R_8$ and $R_9$ represent the same groups as defined for $R_6$, a halogen atom or an alkoxy group.

In the present invention, when A is a cyan coupler residual group represented by Formula [IV] or Formula [V], a cyan coupler residual group represented by Formula [IV] is preferred, and $R_5$ should preferably be a carbamyl group.

On the other hand, when A in the above Formula [I] is an organic residual group which reacts with the oxidized product of a color developing agent but does not form a ye, those represented by the Formulae [VI], [VII] or [VIII] are useful as A in Formula [I].

Formula [VI]

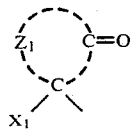

Formula [VII]

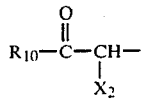

Formula [VIII]

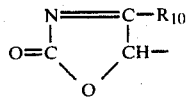

wherein $X_1$ represents a hydrogen atom or a halogen atom (chlorine, bromine, etc.).

$Z_1$ represents a group of non-metallic atoms required for formation of a carbon ring or a heterocyclic ring, for example, a 5-membered or 6-membered saturated or unsaturated carbon ring, said carbon ring including also those forming a fused ring at an appropriate position, specifically exemplified by a single ring or a fused ring such as cyclopentanone ring, cyclohexanone ring, indanone ring benzindanone ring, said carbon ring having at least one substituent such as substituted or unsubstituted alkyl groups, aryl groups, nitro groups, cyano groups, alkoxy groups, aryloxy groups, acylamino groups, sulfonamide groups, sulfamoyl groups, carbamoyl groups, acyloxy groupds, heterocyclic groups, etc.

Typical examples of these substituents may be, in the case of alkyl groups, tert-butyl, octyl, dodecyl, etc.; in the case of aryl groups, phenyl, tolyl, etc.; in the case of alkoxy groups, octyloxy, dodecyloxy, etc.; in the case of aryloxy groups, phenoxy, p-tert-butylphenoxy, naphthoxy, etc.; in the case of acylamino groups, acetamide, butylamide, etc.; in the case of sulfonamide groups, tert-butylsulfonamide, phenylsulfonamide, etc.; in the case of sulfamoyl groups, butylsulfamoyl, phenylsulfamoyl, etc.; in the case of carbamoyl groups, dodecylcarbamoyl, octylcarbamoyl, etc.; in the case of acyloxy groups, dodecanoyloxy, benzoyloxy, 3-pentadecylphenoxyacetoxy, etc.; in the case of heterocyclic groups, preferably 5- to 6-membered heterocyclic rings or fused heterocyclilc rings containing a nitrogen atom, an oxygen atom, a sulfur atom, etc. as a hetero atom, such as benzthiazole group, succinimide group, oxadiazole group, thiadiazole group, triazine group, triazole group, diazole group, pyrimidine group, naphthothiazole group, respectively, and these heterocyclic groups may have also one or more of substituents such as alkyl groups, halogen atoms, acylamino groups, alkylamino groups, alkoxy groups, aryloxy groups, alkoxycarbonyl groups, sulfamoyl groups, carbamoyl groups, nitro groups, cyano groups, etc.

$X_2$ in A represented by Formula [VII] represents a halogen atom, an alkyl group, an aryl group, an alkoxy group or an aryloxy group, and these groups may also have substituents. The above halogen atom may be, for example, fluorine, chlorine, bromine, etc.; the above allkyl group may be, for example, methyl, ethyl, butyl and the like; the above aryl group may be, for example, phenyl, 2-chlorophenyl, 4-nitrophenyl, etc.; the above alkoxy group may be, for example, methoxy, ethoxy, butoxy and the like; and the above aryloxy group may be, for example, phenoxy, 4-hydroxycarbonyl, etc.

$R_{10}$ in A of the above Formulae [VII] and [VIII] represents an alkyl group, an aryl group, etc. and they may also have substituents. As the alkyl group, there may be included, for example, octyl, dodecyl, octadecyl, hydroxyethyl, etc. and as the aryl group, for example, phenyl, p-chlorophenyl, p-dodecyloxyphenyl, etc.

Z in the above Formula [I] may preferably be represented by the following Formula [IX] or [X]:

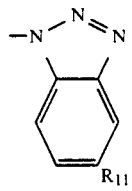

Formula [IX]

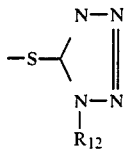

Formula [X]

In the above Formula [IX], $R_{11}$ represents a hydrogen atom, a bromine atom, an alkyl group having 1 to 4 carbon atoms, a nitro group, an alkylacylamino group having 3 to 7 carbon atoms, an alkylsulfonamide group having 4 to 8 carbon atoms, an alkoxy group having 2 to 5 carbon atoms, a phenoxycarbonyl group or an alkoxycarbonyl group having 2 to 6 carbon atoms. Here, the respective alkyl components or alkyl groups may be either straight or branched, or may also have substituents.

In the Formula [X], $R_{12}$ represents a straight or branched alkyl group having 1 to 4 carbon atoms (these alkyl groups may be substituted with methoxy group, ethoxy group, hydroxyl group, carboxy group) or a phenyl group having substituents as mentioned below. As the substituent, there may be included a hydroxy group, an amino group, a sulfamoyl group or a carboxy group.

Also, Z in the above Formula [I] may preferably be a group represented by the following Formula [XI]:

—TIME—$Z^1$ Formula [XI]

wherein TIME group represents a timing group which is bonded to the above coupling component A capable of reacting with the oxidized product of a color developing agent at the coupling position and can react with the oxidized product of the color developing agent to be released from the above A, releasing thereafter $Z^1$ which is the same as Z. As described above, $Z^1$ represents a compound which releases development inhibitor or its precursor, having the same meaning as Z in the above Formula [I].

In the above formula [XI], preferable TIME groups are represented by the following Formulae [XII], [XIII] or [XIV]:

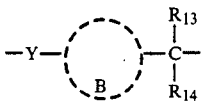

Formula [XII]

wherein B represents a group of atoms necessary for completion of a benzene ring or a naphthalene ring, Y represents —O—, —S— or

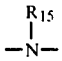

and is bonded to the coupling component of the above Formula [I] at its active point, $R_{13}$, $R_{14}$ and $R_{15}$ represent a hydrogen atom, an alkyl group or an aryl group, and the group

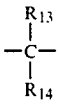

is substituted at the o- or p-position relative to Y and bonded to the hetero atom included in the above Z.

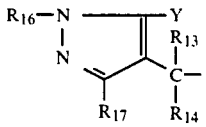

Formula [XIII]

wherein Y, $R_{13}$ and $R_{14}$ each have the same meaning as defined in the above Formula [XII], $R_{16}$ represents a hydrogen atom, an alkyl group, an aryl group, an acyl group, a sulfone group, an alkoxycarbonyl group or a heterocyclic residual group, $R_{17}$ represents a hydrogen atom, an alkyl group, an aryl group, a heterocyclic residual group, an alkoxy group, an amino group, an acid amide group, a sulfonamide group, a carboxy group, an alkoxycarbonyl group, a carbamoyl group or a cyano group.

Also, the timing group in the above Formula [XIII], similarly as in the above Formula [XII], is bonded through Y to the above coupling component A at its active point and through the group

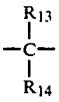

to the hetero group included in the above z.

Next, as the TIME group which can release the above Z through intramolecule nucleophilic substitution reaction, those represented by the following Formula [XIV] may be included.

—Nu—D—E—Z Formula [XIV]

wherein Nu represents a nucleophilic group having oxygen, sulfur or nitrogen atom enriched in electrons, which is bonded to the coupling component A at its coupling position, E represents an electrophilic group having carbonyl group, thiocarbonyl group, phosphinyl group or thiophosphinyl group deficient in electrons; said electrophilic group being bonded to the hetero atom in the development inhibiting group Z, and D represents a group which correlates sterically Nu and E and can destroy the intramolecular nucleophilic substitution accompanied with formation of a 3-membered to 7-membered ring and thereby releaze the above Z.

Specific examples of preferable DIR compounds according to the present invention are shown below, but the present invention is not limited thereto.
(1)
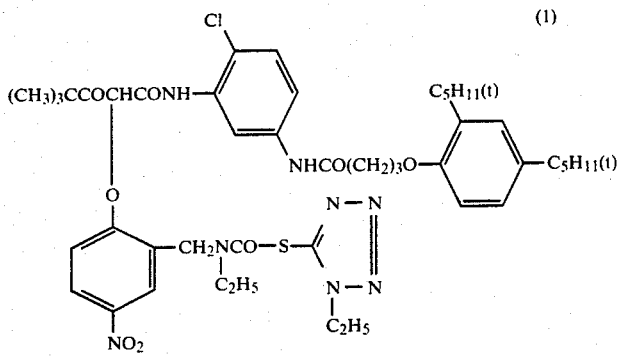
(2)
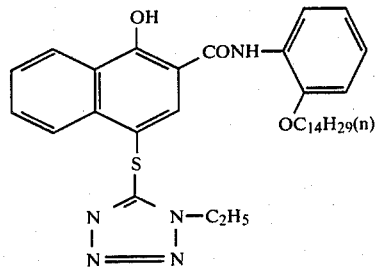
(3)
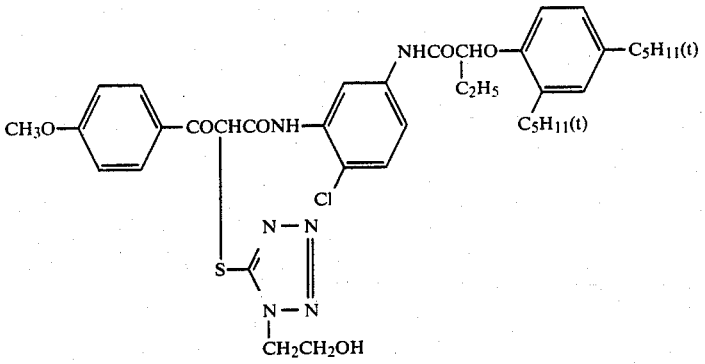
(4)
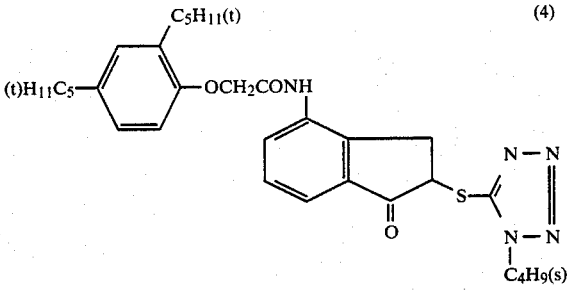
(5)
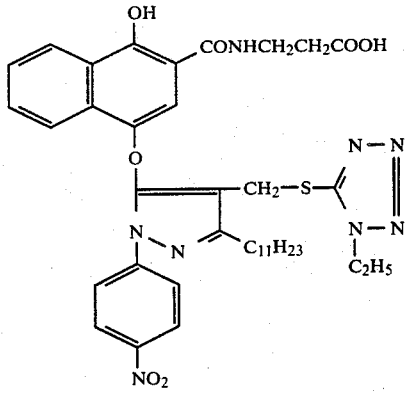
(6)
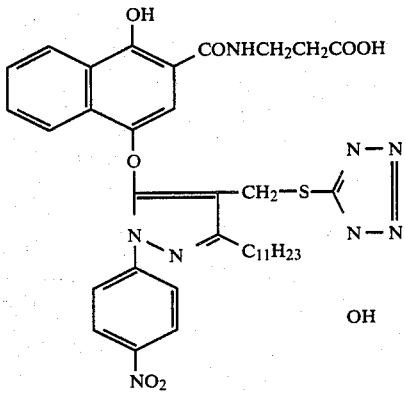
(7)
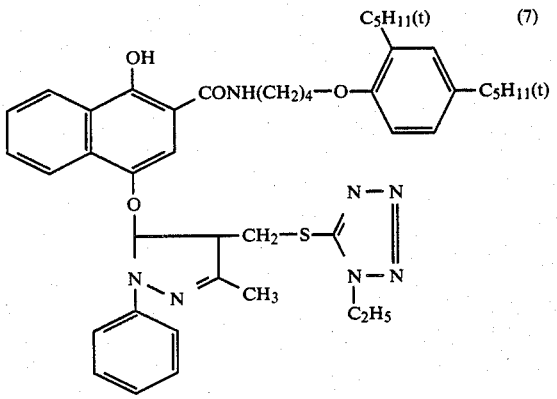

-continued
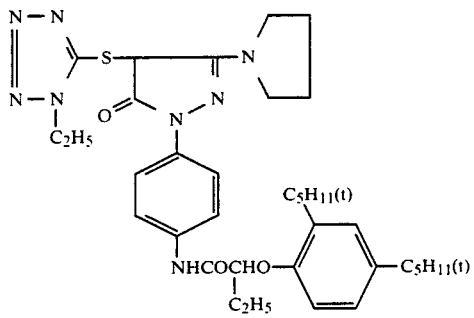
(8)
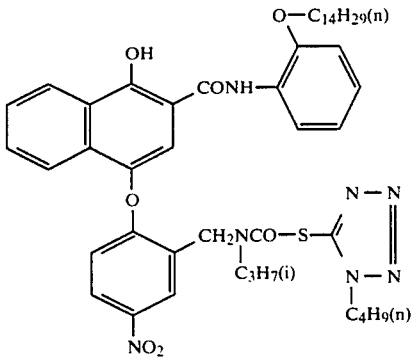
(9)
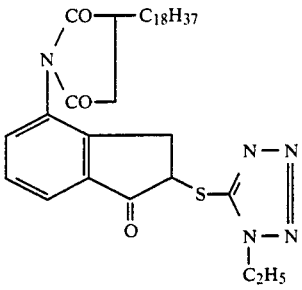
(10)
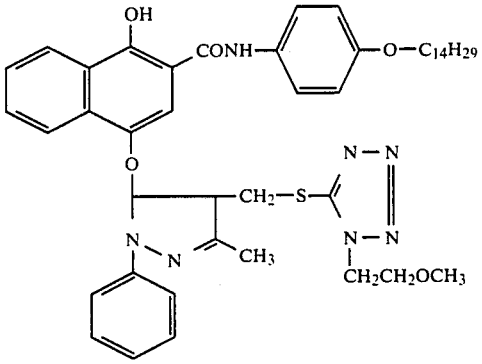
(11)
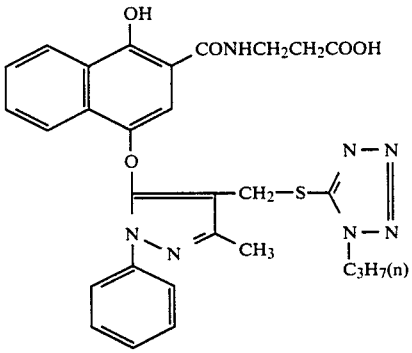
(12)
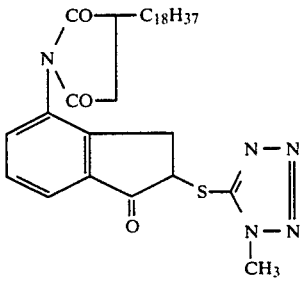
(13)
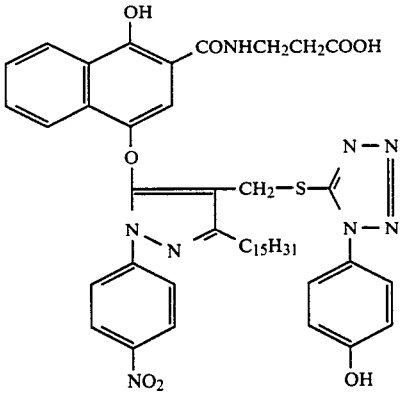
(14)
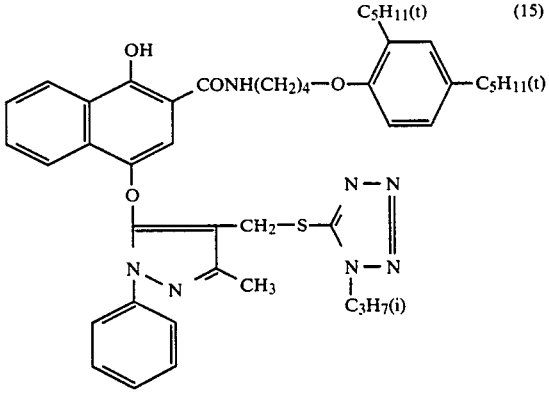
(15)

-continued
(16)
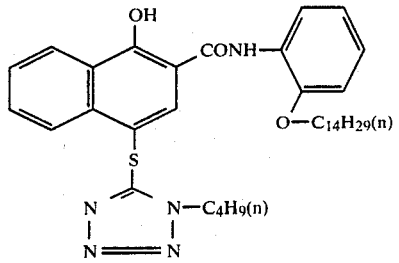
(17)
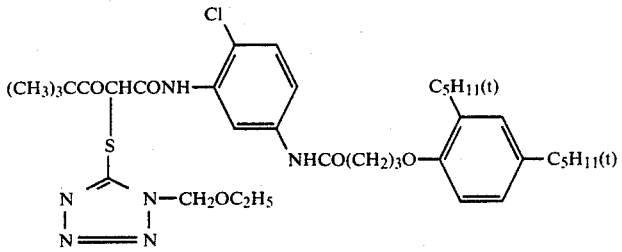
(18)
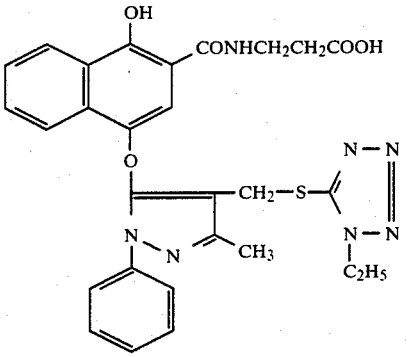
(19)
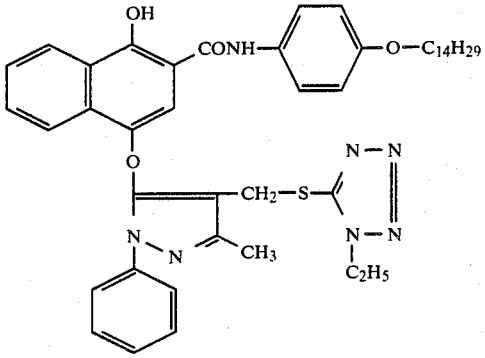
(20)
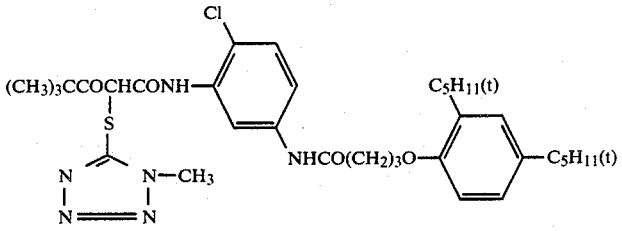
(21)
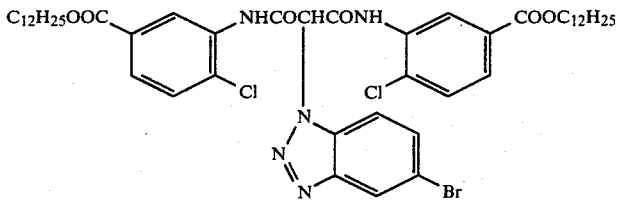
(22)
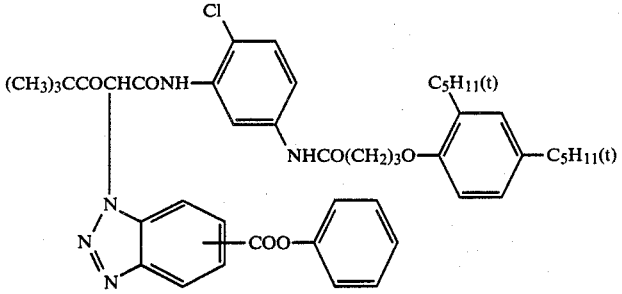

-continued
(23)
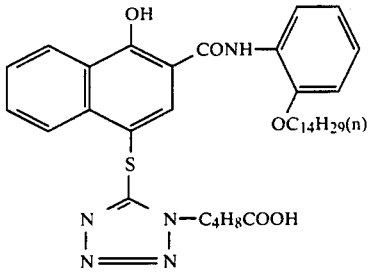
(24)
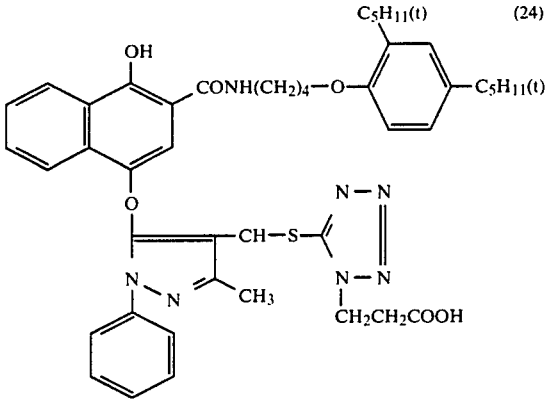
(25)
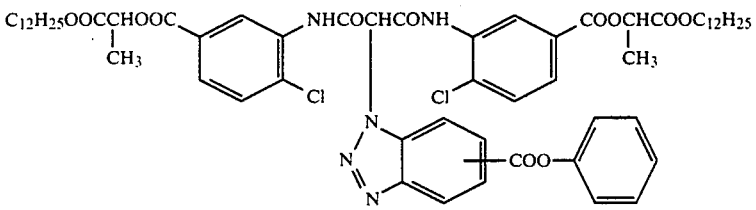
(26)
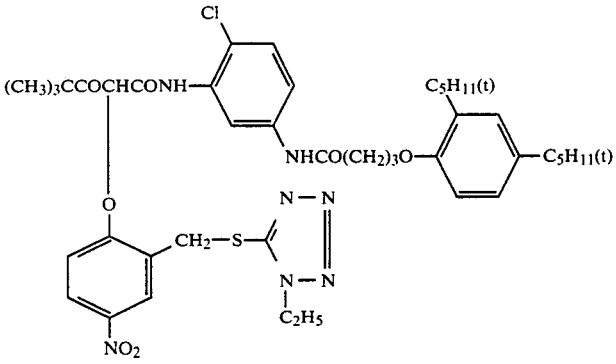
(27)
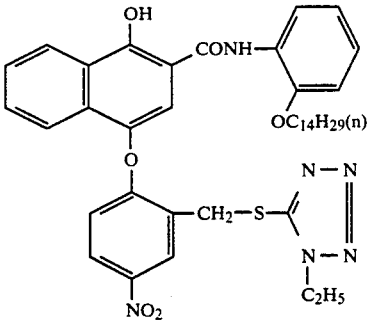
(28)
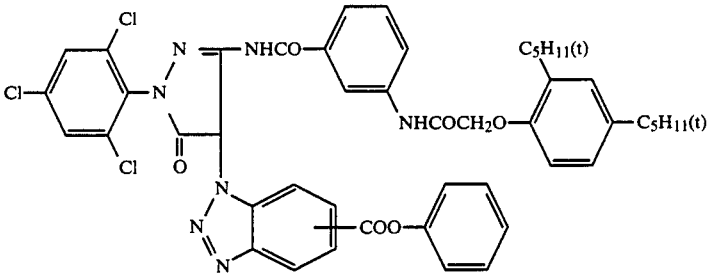

-continued
(29)
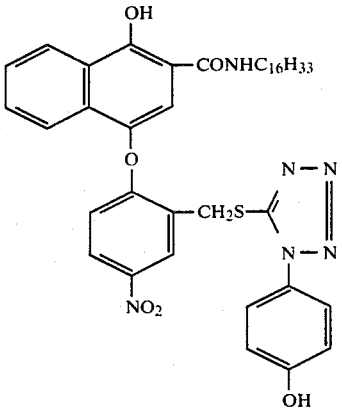
(30)
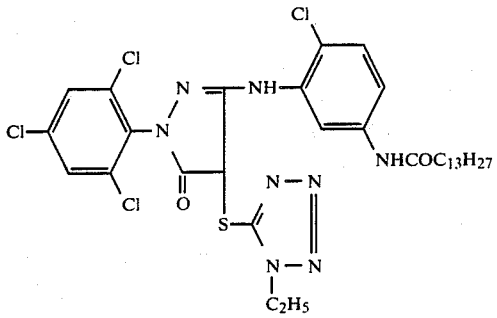
(31)
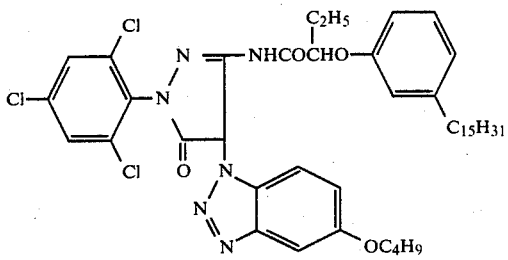
(32)
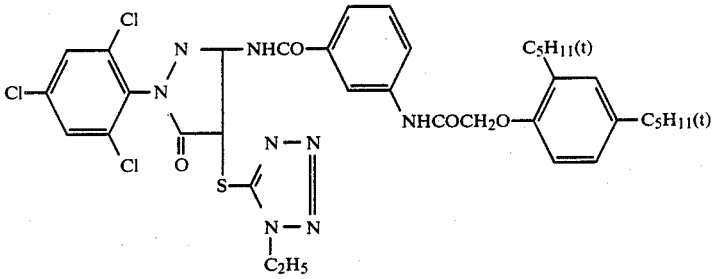
(33)
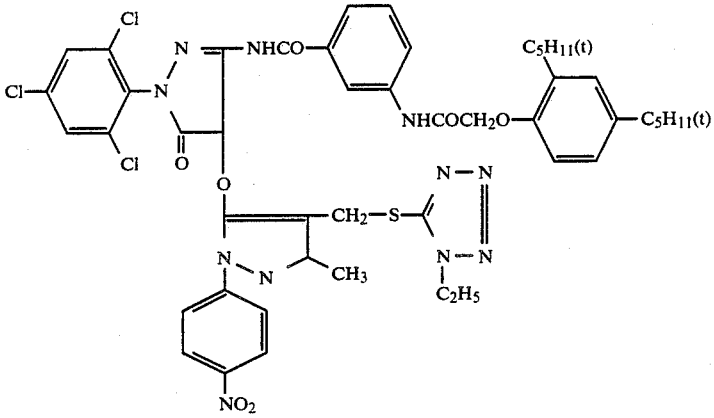

-continued (34)

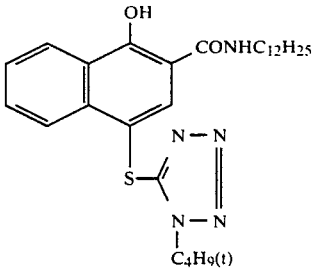

(35)

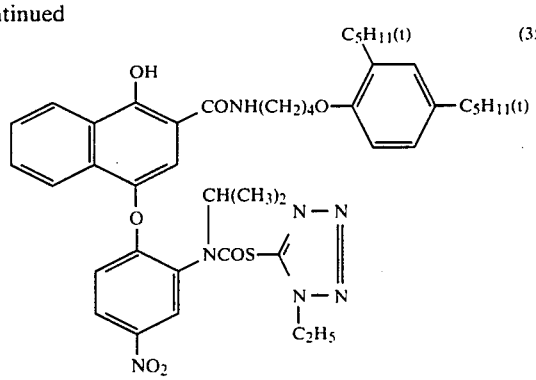

(36)

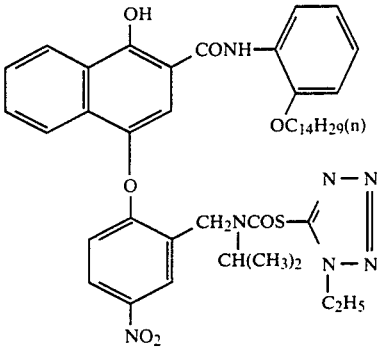

(37)

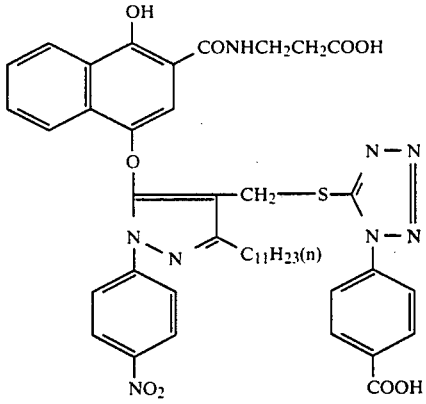

These compounds can be synthesized according to the methods as disclosed in Japanese Unexamined Patent Publication Nos. 154234/1982, 114946/1981; U.S. Pat. Nos. 3,227,554, 4,234,678, 4,149,886, 3,933,500 and 4,248,962.

In the present invention, the photosensitive layer containing the above flat plate grains and the low sensitivity layer containing the above mono-dispersed silver halide grains are applicable for any of the blue-sensitive layer, the green-sensitive layer and the red-sensitive layer.

The flat plate emulsion according to the present invention should preferably be employed in at lease one layer of the respective high sensitivity green-sensitive layer and red-sensitive layer, more preferably in two layers of the green-sensitive and red-sensitive layers, further preferably in all the layers.

The mono-dispersed emulsion for use in low sensitivity layer according to the present invention is required to be used in at least one layer of blue-sensitive, green-sensitive and red-sensitive layers, more preferably applied for two layers, further preferably for all the layers.

When the flat plate grains of the present invention are contained only in one layer in the light-sensitive layer of the present invention, the compound capable of releasing the above diffusable development inhibitor or precursor thereof should preferably be contained in at least one silver halide emulsion layer other than this one layer.

As a preferable embodiment of the present invention, there may be mentioned an embodiment wherein the green-sensitive yellow dye forming layer and the red-sensitive cyan dye forming layer each consists of two or more layers with different sensitivities, the flat plate grains of the present invention are contained in the respective higher sensitivity layers [the highest sensitivity layer when consisting of n layers with different sensitivities ($n \geqq 3$)], and a DIR compound is contained in at least one layer of these higher sensitivity layers.

In the light-sensitive material of the present invention, the compound capable of releasing a diffusable development inhibitor or precursor thereof can be contained in the higher sensitivity layer.

In the light-sensitive material of the present invention, high boiling organic solvents as mentioned below can be incorporated. For example, it is possible to use phthalic acid alkyl esters (dibutyl phthalate, dioctyl phthalate and the like), phosphoric acid esters (diphenyl phosphate, triphenyl phosphate, tricresyl phosphate, dioctylbutyl phosphate), citric acid esters (e.g. tributyl acetylcitrate), benzoic acid esters (e.g. octyl benzoate), alkylamides (e.g. diethyllaurylamide), fatty acid esters (e.g. dibutoxyethyl succinate, dioctyl azelate), trimesic acid esters (e.g. tributyltrimesate), etc.

High boiling organic solvents are disclosed in, for example, U.S. Pat. Nos. 2,322,027, 2,533,514, 2,835,579; Japanese Patent Publication No. 23233/1971; U.S. Pat. No. 3,287,134; U.K. Patent No. 958,441; Japanese Unexamined Patent Publication No. 1031/1972; U.K. Patent No. 1,222,753; U.S. Pat. No. 3,936,303; Japanese Unexamined Patent Publication No. 26037/1976, No. 82078/1975; U.S. Pat. Nos. 2,353,262, 2,852,383, 3,554,755, 3,676,137, 3,676,142, 3,700,454, 3,748,141, 3,837,863; OLS No. 2,538,889; Japanese Unexamined Patent Publication No. 27921/1976, 27922/1976, 26035/1976, 26036/1976, 62632/1975; Japanese Patent publication No. 29461/1974; U.S. Pat. Nos. 3,936,303, 3,748,141; and Japanese Unexamined Patent Publication No. 1521/1978.

In the light-sensitive material of the present invention, the compounds capable of releasing the above development inhibitors or precursors thereor and/or other couplers can be employed. Such couplers may include magenta couplers, yellow couplers and cyan couplers. Typical examples of magenta couplers may include pyrazolone type, pyrazolotriazole type, pyrazolinobenzimidazole type, indazolone type couplers. Such magenta couplers may be those as disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445; West Germany Patent No. 1,814,464; West Germany Patent Applications (OLS) Nos. 2,408,665, 2,417,945, 2,418,959, 2,424,467; Japanese Patent Publication No. 6031/1965; Japanese Unexamined Patent Publications Nos. 20826/1976, 58922/1977, 129538/1974, 74027/1974, 159336/1975, 42121/1977, 74028/1974, 60233/1975, 26541/1976, 55122/1978 and Japanese Patent Application No. 110943/1980.

Of such magenta couplers, colored magenta couplers to be employed may be compounds in which colorless magenta couplers are arylazo-substituted or heteroarylazo-substituted at the active sites, as exemplified by those disclosed in U.S. Pat. Nos. 2,983,608, 2,455,170, 2,725,292, 3,005,712, 3,519,429, 2,688,539; U.K. Patent Nos. 800,262, 1,044,778; and Belgian Patent No. 676,691. On the other hand, as yellow couplers, there may be included benzoylacetanilide type, pivaloylacetanilide type yellow couplers, and further diequivalent yellow couplers with the carbon atom at the position being substituted with a substituent eliminable during the coupling reaction.

Typical examples of the yellow couplers available in the present invention may include those as disclosed in U.S. Pat. Nos. 2,875,057, 3,265,506, 3,408,194, 3,551,155, 3,582,322, 3,725,072, 3,891,445; West Germany Patent No. 1,547,868; West Germany OLS Nos. 2,219,917, 2,261,361, 2,414,006; U.K. Patent No. 1,425,020; Japanese Patent Publication No. 10783/1976; Japanese Unexamined Patent Publications Nos. 26133/1972, 73147/1973, 102636/1976, 6341/1975, 123342/1975, 130442/1975, 21827/1976, 87650/1975, 82424/1977, 115219/1977, 95346/1973.

Further, as cyan couplers, there may be included phenol or naphthol derivaives, and further as colored cyan couplers, there may be included compounds in which arylazo-substituted phenoxy groups are substituted directly or through alkoxy groups at the coupling position of colorless cyan couplers.

Such cyan couplers may include those as disclosed in U.S. Pat. Nos. 2,423,730, 2,474,293, 2,801,171, 2,895,826, 3,476,563, 3,737,326, 3,758,308, 3,893,044; Japanese Unexamined Patent Publications Nos. 37425/1972, 10135/1975, 25228/1975, 112038/1975, 117422/1975, 130411/1975, particularly preferably couplers as disclosed in Japanese Unexamined Patent Publications Nos. 65134/1981, 98731/1983, 204543/1982, 204544/1982 and 204545/1982. Also, as colored cyan couplers for masking couplers, there may be employed compounds as disclosed in U.S. Pat. Nos. 2,521,908, 3,034,892; U.K. Patent No. 1,255,111; Japanese Unexamined Patent Publication No. 22028/1973.

Further, it is also possible to use colored cyan couplers of the type in which the dyes flow out into the processing bath through the reaction with the oxidized product of a color developing agent as disclosed in U.S. Pat. No. 3,476,563; Japanese Unexamined Patent Publication Nos. 10135/1975 and 123341/1975.

Also, a coupler capable of forming a migratable dye through the coupling reaction with the oxidized product of a color developing agent may be available. As the coupler, in addition to usual couplers, it is also desirable to incorporate a coupler having a group which can be removed through the coupling reaction during development to reveal a fogging action (see Japanese Unexamined Patent Publication Nos. 50439/1984 and 150845/1982). By said coupler, the sensitivity of its own layer can be more highly enhanced.

A magenta coupler, yellow coupler and cyan coupler, when it is employed together with a DIR compound in the photosensitive layer, may preferably be employed in an amount ranging from 0.002 mol to 0.5 mol, more preferably from 0.009 mol to 0.35 mol, per 1 mol of silver halide. On the other hand, when these couplers are to be incorporated in the non-photosensitive layer adjacent to silver halide emulsion layer, they should preferably be contained in an amount of $1\times10^{-6}$ mol/dm$^2$ to $8\times10^{-5}$ mol/dm$^2$, more preferably $4\times10^{-6}$ mol/dm$^2$ to $3\times10^{-5}$ mol/dm$^2$.

The light-sensitive material is constituted basically of a support and photosensitive emulsion layers, but depending on the kind of the light-sensitive silver halide photographic material, it is generally combined in layers appropriately together with auxiliary layers such as subbing layer, intermediate layer, filter layer, halation preventive layer, curl preventive layer, back layer, protective layer, etc.

In the photosensitive layers or other auxiliary layers of the light-sensitive material of the present invention, it is preferable for exhibiting fully the effect of the present invention to use a reducing agent or an antioxidant such as sulfites (sodium sulfite, potassium sulfite and the like), bisulfites (sodium bisulfite, potassium bisulfite and the like), hydroxylamines (hydroxylamine, N-methylhydroxylamine, N-phenylhydroxylamine and the like), sulfinic acids (sodium phenylsulfinate, etc.), hydrazines (N,N'-dimethylhydrazine, etc.), reductones (ascorbic acid, etc.), aromatic hydrocatons having one or more hydroxyl group (p-aminophenol, gallic acid, catechol, pyrogallol, resorcin, 2,3-dihydroxynaphthalene, etc.).

Further, for the purpose of increasing stability of the dye image formed, it is possible to incorporate alkyl-substituted hydroquinones and alkoxy derivatives thereof, bishydroquinones, polymeric hydroquinones, etc. alone or in a combination of two or more compounds in the emulsion layers containing the compound of the present invention or in layers adjacent thereto. Further, p-alkoxyphenols, 6-couromanol, 6,6'-dihydroxy-2,2'-spirocouromane and alkoxy or acyloxy derivatives thereof may similarly be employed.

The light-sensitive material of the present invention may also contain benzotriazoles, triazines or benzophenone type compounds or acrylonitrile compounds as UV-ray absorbers in the photographic constituent layers thereof (e.g. protective layer, intermediate layer, emulsion layer, back layer, etc.).

For formation of the light-sensitive material, silver halide can be dispersed in an appropriate protective colloid to form a photosensitive layer. As the protective colloid to be used in the photographic constituent layers, including said photosensitive layer as well as other non-photosensitive layers such as intermediate layer, protective layer, filter layer, etc., there may be included generally alkali-treated gelatin, or otherwise acid-treated gelatin, derivative gelatin, colloidal albumin, cellulose derivative or synthetic resins such as polyvinyl alcohol, polyvinyl pyrrolidone, etc., which may be used either alone or in combination.

The light-sensitive material can be produced by coating on a support. As the support in this case, it is possible to use plastic films, plastic laminate papers, baryta papers, synthetic papers, and further rigid material sch as glass plates, metals, earthenware, etc.

As other silver halide emulsions to be used in the light-sensitive materials of the present invention, any desired silver halide emulsion to be used in this field of the art may be applicable. For example, crystals of silver chloride, silver bromide, silver iodobromide, silver chlorobromide silver chloroiodide or silver chloroiodobromide or mixtures of these crystals may be included. Said silver halide emulsion may be either of large grains or small grains, and either mono-dispersed or poly-dispersed. Also, silver halide crystals may be any one of cubic crystal, octahedral crystal, epitaxial hybridized crystal and others. Said emulsion can be made as nega emulsion or directly a posi emulsion. They can be used either as the surface latent image type emulsion in which latent images are formed on the silver halide grains, the inner latent image type emulsion in which latent images are formed internally of silver halide grains or as a mixture of the surface latent image type emulsion and the inner latent image type emulsion.

When the photosensitive layer of the present invention consists of a plurality of silver halide emulson layers which are substantially the same in color sensitivity but different in photosensitivity as mentioned above, specifically two or three layers of silver halide emulsion layers with different photosensitivities, the difference $\Delta \log E$ in sensitivity between the respective silver halide emulsion layers with different photosensitivities, which cannot wholly be determined, may generally 0.1 to 1.0, preferably 0.2 to 0.7.

The silver halide emulsion to be used in the photosensitive layer containing flat plate grains according to the present invention and the low sensitivity layer containing mono-dispersed silver halide grains, and other photographic emulsions to be used in the light-sensitive material of the present invention may be applied with doping with various metal salts or metal complexes during formation of silver halide precipitates, during growth of grains or after completion of the growth. For example, metal salts or complexes of gold, platinum, palladium, iridium, rhodium, bismuth, cadmium, copper, etc. and combinations thereof may be applicable. Also, in the above preparation method, as a means for desalting, Noodel water washing method, dialysis method or coagulation precipitation method conventionally used for emulsions in general may be used as desired.

Further, the above silver halide emulsion may be chemically sensitized with a sulfur sensitizer such as allyl thiocarbamide, thiourea, cystine, etc.; an active or inactive selenium sensitizer; and a reducing sensitizer such as a stannous salt, a polyamine etc.; a noble metal sensitizer such as a gold sensitizer, typically potassium aurithiocyanate, potassium chloroaurate, 2-aurosulfobenzothiazole methochloride, etc.; or a sensitizer such as a water soluble salt of ruthenium, rhodium, iridium, etc., typically ammonium chloropalladate, potassium chloroplatinate and sodium chloropalladite (certain kinds of these may act as sensitizer or angifoggant depending on its amount), etc., either singly or suitably in a combination (e.g. combined use of a gold sensitizer and a sulfur sensitizer or a combined use of a gold sensitizer or a selenium sensitizer, etc.).

Further, the photographic emulsion according to the present invention can also be spectrally sensitized or subjected to color intensifying sensitization by using either singly or in combination cyanine dyes such as cyanine, melocyanine, carbocyanine, etc. or a combination of them with styryl dyes, etc.

These color sensitizing techniques have been known from olden times, and selection of the combination of dyes can be determined freely depending on the purpose and use of the light-sensitive silver halide photographic material such as the wavelength region to be sensitized, sensitivity, etc.

In the above silver halide emulsion, for prevention of lowering in sensitivity and generation of fog during the preparation steps, storage or processing of the light-sensitive silver halide emulsion, various compounds may be added, for example, heterocyclic compounds such as 1-phenyl-5-mercaptotetrazole, 3-methylbenzothiazole, 4-hydroxy-6-methyl-1,3,3a,7-tetrazaindene, etc., mercapto compounds, metal salts, etc.

The film hardening treatment of the emulsion by be practiced following the conventional method. The film hardener to be employed may be any conventional film hardener for photography, including aldehyde compounds such as formaldehyde, glyoxal, glutaraldehyde, etc. and derivative compounds such as acetal or sodium bisulfite adducts thereof, and further methanesulfonic acid ester compounds, mucochloric acid, mucohalogenic acid compounds, epoxy compounds, aziridine compounds, active halogen compounds, maleimide compounds, active vinyl compounds, carbonimide compounds, isooxazole compounds, N-methylol compounds, isocyanate compounds, or inorganic film hardeners such as chromium alum, zirconium sulfate, etc.

In the above silver halide emulsion, surfactants may also be added either singly or as a mixture. They can be applied for the purpose of coating aid, emulsification, sensitization, improvement of photographic characteristics, prevention of charging or prevention of adhesion. These surfactants may be classified into natural surfactants such as saponin; nonionic surfactants such as alkyleneoxide type, glycerine type, glycidol type, etc.; cationic surfactants such as higher alkylamines, quaternary ammonium salts, pyridine and other heterocyclic rings, phosphoniums or sulfoniums; anionic surfactants containing acidic groups such as carboxylic acid, sulfonic acid, phosphoric acid, sulfate ester group, phosphate ester group, etc.; amphoteric surfactants such as amino acids, aminosulfonic acids, sulfate or phosphate esters of amino alcohols, etc.

Formation of the color phtographic image by use of the light-sensitive material of the present invention can be realized in various modes of light-sensitive materials. One of them is a system in which a light-sensitive material having a silver halide emulsion layer containing a diffusion resistant coupler on a support is treated with an alkaline developer containing an aromatic primary amine color developing agent, thereby permitting a water insoluble or diffusion resistant dye to remain in the emulsion layer. According to another mode, a light-sensitive material having a silver halide emulsion layer combined with a diffusion resistnt coupler on a support is treated with an alkaline developer containing an aromatic primary amine color developing agent to make it soluble in an aqueous medium, thus forming a diffusible dye and permitting it to be transferred onto an image receiving layer comprising other hydrophilic colloid. That is, this process is a diffusion transfer color system.

The light-sensitive material of the present invention is inclusive of all kinds of light-sensitive silver halide color photographic materials such as color negative film, color positive film, color reversal film, color paper, etc.

As an embodiment of the light-sensitive material of the present invention, there is a multi-layer multi-color light-sensitive silver halide photographic material having a green-sensitive silver halide emulsion layer containing a magenta coupler, a blue-sensitive silver halide emulsion layer containing a yellow coupler and a red-sensitive silver halide emulsion layer containing a cyan coupler on a support. For blue-sensitive silver halide emulsion, green-sensitive silver halide emulsion and red-sensitive silver halide emulsion in such a light-sensitive material, known emulsions, in addition to the constitution of the present invention, may be employed as desired.

The light-sensitive material of the present invention, after exposure, may be subjected to the color developing method conventionally used to give a color image. The basic steps in the nega-posi method include color developing, bleaching and fixing steps. On the other hand, the basic steps in the reversal method include the respective steps of developing in a first developer, subsequently giving white light exposure or treating with a bath containing a fogging agent, color developing, bleaching and fixing.

These respective steps may be conducted independently in some cases or only one processing may be conducted in a processing solution endowed with the functions of two or more steps in some cases. For example, there may be employed the one-bath color processing method in which a color developing agent, a ferric salt bleaching component and a thiosulfate fixing component are contained in one bath, or the one-bath bleach-fixing method in which ferric ethylenediaminetetraacetate bleaching component and a thiosulfate fixing component are contained in one bath.

Each step may also be processed in two or more divided times, if desired, or alternatively a combination of processings such as color developing, first fixing and bleach-fixing may also be possible. The developing processing step may be combined, in addition to the above, with various steps such as pre-film-hardening bath, neutralization bath, image stabilizing bath, water washing, etc. The processing temperature may sometimes be lower than 18° C., but 18° C. or higher in most cases. Particularly, the temperature range of from 20° C. to 26° C. is frequently used. For rapid processing, a temperature of about 30° to 60° C. is suitable. The setting temperature in the series of the processing steps is not necessarily the same temperature.

The color developing solution is an aqueous alkali solution containing a developing agent with a pH of 8 or higher, preferably 9 to 12. The above developing agent means a compound having a primary amine group on an aromatic ring and capable of developing silver halide exposed or a precursor which forms such a compound. Preferably, it is a phenylenediamine type compound, including, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxy ethylaniline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethyaniline, 3-acetamido-4-amino-N,N-diethylaniline, 4-amino-N,N-dimthylaniline, N-ethyl-N-β-[β-(β-methoxyethoxy)ethoxy]ethyl-3-methyl-4-aminoaniline, N-ethyl-N-β-[β-methoxyethoxy]ethyl-3-methyl-4-aminoaniline, salts thereof, such as sulfates, hydrochlorides, sulfites, p-toluenesulfonic acid salts, etc.

In the color developer, various additives may be added, if desired. Primary examples may include alkali agents (e.g. alkali metal or ammonium hydroxides, ammonium carbonates, ammonium phosphates, etc.), pH controllers or buffers (e.g. weak acids such as acetic acid, boric acid or weak bases or salts thereof); developing promotors (e.g. pyridinium compounds, cationic compounds; potassium nitrate or sodium nitrate, nonionic compounds such as polyethylene glycol condensates or derivatives thereof, polythioethers, etc.; polymer compounds having sulfite ester, otherwise organic amines such as pyridine, ethanolamine, etc.; benzyl alcohol, hydrazines, etc.); antifoggants (e.g. alkali bromide, alkali iodide or nitrobenzoimidazoles, mercaptobenzoimidazole, 5-methylbenzotriazole, 1-phenyl-5-mercaptotetrazole, compounds for rapid processing lilquors, thiosulfonyl compounds, phenazine-N-oxides, nitrobenzoic acid benzothiazolium derivatives, etc.), stain or sludge preventives, interlayer effect accelerator, preservatives (e.g. sulfites, acidic sulfites, hydroxylamine hydrochlorides, formsulfite, alkanolamine sulfite adducts, etc.) and so on.

The light-sensitive material of the present invention can be applied with the color developing processing without impairing practical characteristics even in the presence of a competing coupler such as citrazinic acid.

The light-sensitive material of the present invention, after color developing processing, may be subjected to bleaching processing in a conventional manner. This processing may be simultaneous with or separate from fixing. The processing liquor may be made a bleach-fixing liquor by addition of a fixing agent, if desired.

Various compounds may be used as the bleaching agent, but among them, red prussiates; bichromates; polyvalent metal compounds such as of iron (III), cobalt (III) and copper (II), above all, complexes of these polyvalent metal cations with organic acids, such as metal complexes of aminopolycarboxylic acids such as ethylenediaminetetraacetic acid, nitrilotriacetic acid, diaminopropanoltetraacetic acid, citric acid, tartaric acid, malic acid, etc. or peracids such as alkyl peracid, persulfate, permanganate, hydrogen peroxide, etc., hypochlorites such as chlorine, bromine, bleaching powder, may generally be employed either singly or in a suitable combination. Further, various additives, typically a bleaching accelerator, may be added into the processing liquor.

After the color developing processing, conventional photographic processings may be practiced in a suitable combination, such as respective processings selected from processing with processing liquors such as stopping liquor containing organic acid, stopping fixing liquor containing organic acid or fixing components such as hypo or ammonium thiosulfate, fixing liquor containing hypo or ammonium thiosulfate, bleaching liquor containing main components of ferric salt of an aminopolycarboxylic acid and an alkali halide, a bleach-fixing liquor containing a ferric salt of an aminopolycarboxylic acid and a fixing component such as hypo or ammonium thiosulfate, or other stabilizing liquors and processing with washing with water and drying.

The light-sensitive material of the present invention may also contain the above color developing agent either as the color developing agent itself or as a precursor thereof in the hydrophilic colloid layer. The color developing agent precursor is a compound capable of forming a color developing agent under alkaline conditions, including, for example, Schiff base type precursors with an aromatic aldehyde derivative, polyvalent metal ion complex precursors, phthalimide derivative precursors, phosphoroamide derivative precursors, sugar amine reactant precursors, urethane type precursors, etc. The precursors of aromatic primary amine color developing agents are disclosed in, for example U.S. Pat. Nos. 3,342,599, 2,507,114, 2,695,234, 3,719,492; U.K. Pat. No. 803,783; Japanese Unexamined Patent Publication Nos. 135628/1978, 79035/1979; Research Disclosure Nos. 15159, 12146 and 13924.

These aromatic primary amine color developing agents or precursors thereof are required to be added in amounts which can give sufficient color formation during developing processing. The amount may differ depending considerably on the kind of the light-sensitive material, but it is generally from 0.1 mol to 5 mols per mol of the silver halide, preferably from 0.5 mol to 3 mols. These color developoing agents or precursors thereof may be used either singly or in combination. For the above compounds to be built in within the light-sensitive photographic material, they can be added as solutions dissolved in an appropriate solvent such as water, methanol, ethanol, acetone, etc. or as emulsions employing a high boiling organic solvent such as dibutyl phthalate, dioctyl phthalate, tricresyl phosphate, etc. It is also possible to add them impregnated within a latex polymer as disclosed in Research Disclosure No. 14850.

The present invention is described in more detail by referring to the following examples, by which the embodiments of the present invention are not limited at all.

EXAMPLE 1

On a transparent support comprising a cellulose triacetate film applied with subbing working, the respective layers shown below were successively provided by coating to prepare samples.

In Example 1, the amounts added into the light-sensitive materials are shown per $m^2$ of the material, and silver halide emulsion and colloidal silver are shown in terms of values as calculated on silver.

Samples 1 to 11

Layer 1: Halation preventive layer containing 0.3 g of black colloidal silver and 2 g of gelatin.

Layer 2: Intermediate layer containing 1.0 g of gelatin.

Layer 3: Low sensitivity red-sensitive silver iodobromide emulsion layer containing 1.5 g of silver iodobromide as shown in Table 1-1 [containing 1.5 g of gelatin, 0.9 g of a cyan coupler (C-1) and 0.07 g of a colored cyan coupler (CC-1), and further 0.02 g of a DIR compound (exemplary compound (5))].

Layer 4: High sensitivity red-sensitive silver iodobromide emulsion layer containing 1.5 g of a silver iodobromide layer as shown in Table 1-2 [containing 1.5 g of gelatin, 0.17 g of a cyan coupler (C-1) asnd 0.03 g of a colored cyan coupler (CC-1), and further 0.02 g of a DIR compound (exemplary compound (5))].

Layer 5: The same intermediate layer as Layer 2.

Layer 6: Low sensitivity green-sensitive silver iodobromide emulsion layer containing 1.5 g of a silver iodobromide as shown in Table 1-1 [containing 1.5 g of gelatin, 0.8 g of a magenta coupler (M-1) and 0.12 g of a colored magenta coupler (CM-1), and further 0.02 g of a DIR compound (examplary compound (5))].

Layer 7: High sensitivity green-sensitive silver iodobromide emulsion layer containing 1.5 g of a silver iodobromide as shown in Table 1-2 [containing 1.5 g of gelatin, 0.17 g of a magenta coupler (M-1) and 0.05 g of a colored magenta coupler (CM-1), and further 0.02 g of a DIR compound (exemplary compound (5))].

Layer 8: Yellow filter layer containing 0.06 g of di-n-butylphthalate containing 0.1 g of yellow colloid silver and 0.1 g of an anti-staining agent (HQ-1) dissolved therein and 1.5 g of gelatin.

Layer 9: Low sensitivity blue-sensitive silver iodobromide emulsion layer containing 0.9 g of silver iodobromide as shown in Table 1-1 [containing 1.0 g of gelatin, 1.5 g of a yellow coupler (Y-1) and 0.06 g of a DIR compound (exemplary compound (5))].

Layer 10: High sensitivity blue-sensitive silver iodobromide emulsion layer containing 1.0 g of silver iodobromide as shown in Table 1-2 [containing 1.0 g of gelatin, 0.3 g of a yellow coupler (Y-1) and 0.06 g of a DIR compound (exemplary compound (5))].

Layer 11: Protective layer containing 1.5 g of gelatin.

(Y-1)

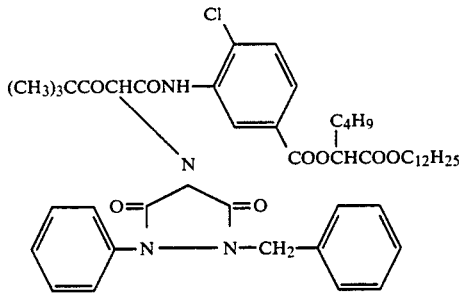

(M-1)

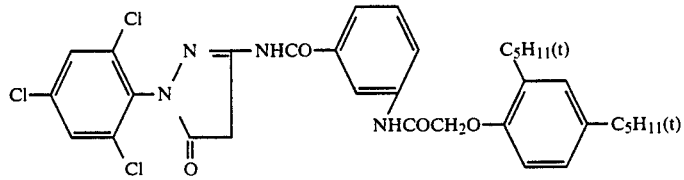

-continued

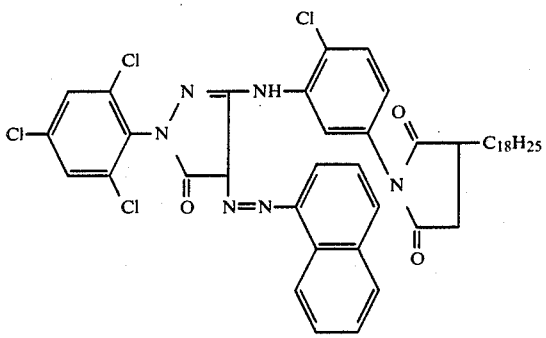

(CM-1)

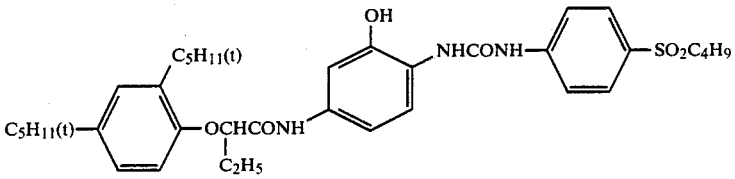

(C-1)

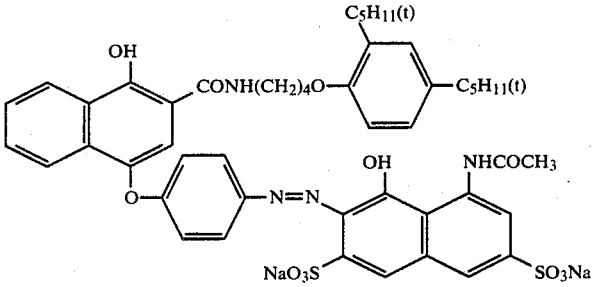

(CC-1)

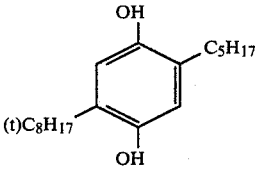

(HQ-1)

TABLE 1-1

| Sample No. | $\bar{r}$ (μm) | $s/\bar{r}$ (%)*5 | Core composition Br:I | Shell composition Br:I | Core volume (%) | Grain shape |
|---|---|---|---|---|---|---|
| | Silver halide emulsions in Layers 3,6 and 9 | | | | | |
| 1 (The invention) | 0.80 | 90 | 90:10 | 98:2 | 50 | Tetradecahedral |
| 2 (The invention)*4 | 0.80 | 90 | 80:20 | 99:1 | 50 | Octahedral |
| 3 (Control) | 0.90 | 55 | 90:10 | 98:2 | 50 | Tetradecahedral |
| | 0.35 | | 90:10 | 96:4 | 50 | Tetradecahedral |
| | (6:4 mixture) | | | | | |
| 4 (The invention) | 0.90 | 72 | 90:10 | 98:2 | 50 | Tetradecahedral |
| | 0.55 | | 90:10 | 98:2 | 50 | Tetradecahedral |
| | (3:1 mixture) | | | | | |
| 5 (The invention) | 0.70 | 77 | 90:10 | 98:2 | 50 | Twin |
| 6 (Control) | 0.65 | 45 | Average AgI content:6 mol % | | | Twin |
| 7 (The invention) | 0.80 | 90 | 90:10 | 98:2 | 50 | Tetradecahedral |
| 8 (The invention)*4 | 0.80 | 90 | 90:10 | 98:2 | 50 | Tetradecahedral |
| 9 (The invention) | 0.80 | 90 | 90:10 | 98:2 | 50 | Tetradecahedral |
| 10 (Control) | 0.65 | 45 | Average AgI content:6 mol % | | | Twin |
| 11 (The invention) | 0.80 | 88 | 93:7*1 | 100:2*2 | 15*3 | Octahedral (host crystal) |

*1Halogen composition of host crystal for epitaxial type crystal
*2Halogen composition of the epitaxial growth portion for epitaxial type crystal.
*3Volume of the epitaxial growth portion of epitaxial type crystal (%)
*4containing no DIR compound (exemplary compound (5)) in Layers 4,7 and 10.
*5$s/\bar{r}$ (%):Weight of grains within the range of ± 20% of $\bar{r}$.

TABLE 1-2

| Sample No. | $\bar{r}$ (μm) | s/$\bar{r}$ (%)*5 | Aspect ratio | Composition of the central portion Br:I | Composition of the outside portion Br:I | Volume of the central portion (%) |
|---|---|---|---|---|---|---|
| | Silver halide emulsions in Layers 4, 7 and 10 | | | | | |
| 1 (The invention) | 3.5 | 35 | 8:1 | 90:10 | 98:2 | 60 |
| 2 (The invention)*4 | 3.5 | 35 | 8:1 | 90:15 | 98:2 | 60 |
| 3 (Control) | 3.5 | 35 | 8:1 | 90:10 | 98:2 | 60 |
| 4 (The invention) | 3.5 | 35 | 8:1 | 90:10 | 98:2 | 60 |
| 5 (The invention) | 3.5 | 35 | 8:1 | 90:10 | 98:2 | 60 |
| 6 (Control) | 3.5 | 35 | 8:1 | 90:10 | 98:2 | 60 |
| 7 (The invention) | 5.1 | 37 | 15:1 | 80:20 | 98:2 | 50 |
| 8 (The invention)*4 | 3.6 | 36 | 10:1 | 93:7*1 | 100:0*2 | 10*3 |
| 9 (The invention) | 4.8 | 39 | 15:1 | 0:100*1 | 98:2*2 | 20*3 |
| 10 (Control) | 4.8 | 39 | 15:1 | 0:100 | 98:2 | 20 |
| 11 (The invention) | 3.5 | 35 | 8:1 | 90:10 | 98:2 | 60 |

*1Halogen composition of host crystal for epitaxial type crystal
*2Halogen composition of the epitaxial growth portion for epitaxial type crystal.
*3Volume of the epitaxial growth portion of epitaxial type crystal (%)
*4containing no DIR compound (exemplary compound (5)) in Layers 4,7 and 10.
*5s/$\bar{r}$ (%):Weight of grains within the range of ±20% of $\bar{r}$.

Each of the sample Nos. 1 to 11 thus obtained was subjected to wedge exposures by use of respective light sources of white, blue, green and red color, developed as described below and then sensitometry evaluation was conducted. The color reproduction (interimage effect) was evaluated by representing the fluctuations in gradation (gamma) due to difference in light sources in terms of ratios.

In these symbols, $\gamma_{NR}$, $\gamma_{NG}$ and $\gamma_{NB}$ represent gamma values of blue, green and red layers relative to white light source, respectively, $\gamma_{SB}$ the gamma value of the blue sensitive layer relative to blue light source, $\gamma_{SG}$ the gamma value of the green sensitive layer relative to green light source and $\gamma_{SR}$ the gamma value of the red sensitive layer relative to red light source.

Also, as the evaluation of color image sharpness, NTF (Modulation Transfer Function) was determined, and MTF value at 20 lines/mm was compared with each other as relative value (with the value of Control sample No. 6 as being 100).

| [Processing step] (38° C.) | Processing time |
|---|---|
| Color developing | 3 min. 15 sec. |
| Bleaching | 1 min. 30 sec. |
| Water washing | 3 min. 15 sec. |
| Fixing | 6 min. 30 sec. |
| Water washing | 3 min. 15 sec. |
| Stabilizing bath | 1 min. 30 sec. |

The processing liquors employed in the processing steps had the following compositions.

| | |
|---|---|
| [Color developer composition] | |
| 4-Amino-3-methyl-N—ethyl-N—(β-hydroxylethyl)-aniline sulfate | 4.75 g |
| Anhydrous sodium sulfite | 4.25 g |
| Hydroxyamine ½sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| (made up to one liter with addition of water, and adjusted to pH 10.0 with potassium hydroxide) | |
| [Bleaching liquor composition] | |
| Iron ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| (made up to one liter with addition of water, and adjusted to pH 6.0 with aqueous ammonia solution) | |

-continued

| | |
|---|---|
| [Fixing liquor composition] | |
| Ammonium thiosulfate (50% aqueous solution) | 162 ml |
| Anhydrous sodium sulfite | 12.4 g |
| (made up to one liter with addition of water, and adjusted to pH 6.5 with acetic acid) | |
| [Stabilizing liquor composition] | |
| Formalin (57% aqueous solution) | 5.0 ml |
| Konidax (produced by Konishiroku Photo Industry K.K.) | 7.5 ml |
| (made up to one liter with addition of water) | |

The results are shown in Table 2.

TABLE 2

| Sample No. | Color reproducibility (Interimage effect) $\gamma_{SB}/\gamma_{NB}$ | $\gamma_{SG}/\gamma_{NG}$ | $\gamma_{SR}/\gamma_{NR}$ | Sharpness (MTF relative value) B | G | R |
|---|---|---|---|---|---|---|
| 1 (The invention) | 1.29 | 1.37 | 1.33 | 114 | 128 | 113 |
| 2 (The invention) | 1.28 | 1.38 | 1.32 | 115 | 130 | 114 |
| 3 (Control) | 1.09 | 1.15 | 1.14 | 106 | 110 | 105 |
| 4 (The invention) | 1.20 | 1.31 | 1.22 | 107 | 116 | 107 |
| 5 (The invention) | 1.26 | 1.34 | 1.30 | 111 | 122 | 110 |
| 6 (Control) | 1.05 | 1.10 | 1.09 | 100 | 100 | 100 |
| 7 (The invention) | 1.30 | 1.39 | 1.28 | 115 | 127 | 113 |
| 8 (The invention) | 1.35 | 1.45 | 1.37 | 122 | 145 | 118 |
| 9 (The invention) | 1.37 | 1.48 | 1.40 | 125 | 142 | 122 |
| 10 (Control) | 1.03 | 1.06 | 1.05 | 95 | 90 | 92 |
| 11 (The invention) | 1.31 | 1.39 | 1.30 | 117 | 132 | 114 |

As can be seen from Table 2, by combined use of the silver halide emulsions of the present invention, marked improvement effects could be recognized with respect to sharpness and color reproducibility without impairment of high sensitivity.

Also, the effects of the present invention are particularly great in sample Nos. 8 and 9, in which emulsions comprising epitaxial type flat particles are used in the high sensitivity layer. Also, the effects of the present invention are particularly great, when the low sensitivity layer emulsion is a core/shell type or epitaxial type emulsion.

Also, the effects of the present invention are greater when the emulsion for low sensitivity layer consists only of mono-dispersed emulsion, and smaller as the grains size of the emulsion mixed is smaller.

EXAMPLE 2

In sample No. 8 of Example 1, the DIR compound used in the Layers 3, 4, 6, 7, 9 and 10 (exemplary compound (5)) was replaced by exemplary compounds (1), (6), (10) and (25) to prepare samples No. 12 to 15, respectively, which were evaluated in entirely the same manner as in Example 1. The results are shown in Table 3.

TABLE 3

| Sample No. | Color reproducibility (Interimage effect) $\gamma_{SB}/\gamma_{NB}$ | $\gamma_{SG}/\gamma_{NG}$ | $\gamma_{SR}/\gamma_{NR}$ | Sharpness (MTF relative value) B | G | R |
|---|---|---|---|---|---|---|
| 12 (The invention) | 1.31 | 1.44 | 1.34 | 121 | 142 | 115 |
| 13 (The invention) | 1.32 | 1.47 | 1.37 | 124 | 144 | 117 |
| 14 (The invention) | 1.30 | 1.42 | 1.35 | 120 | 140 | 115 |
| 15 (The invention) | 1.32 | 1.45 | 1.36 | 123 | 142 | 116 |
| 6 (Control) | 1.05 | 1.10 | 1.09 | 100 | 100 | 100 |

As can be seen from Table 3, the effects of the present invention are not dependent on the structure of DIR compounds, but excellent sharpness and color reproducibility can be obtained.

EXAMPLE 3

On supports comprising cellulose triacetate films applied with subbing working, the respective layers shown below were successively laminated to prepare sample Nos. 16 to 24.

Samples 16 to 21

Layer 1: Halation preventive layer containing black colloid silver (dried film thickness 20 μm).

Layer 2: Intermediate layer comprising gelatin (dried film thickness 0.8 μm).

Layer 3: Red-sensitive low sensitivity silver halide emulsion layer: an emulsion as shown in Table 4-1 (containing 0.25 mol of silver halide and 20 g of gelatin per 1 kg) is prepared in a conventional method. 1 kg of this emulsion is chemically sensitized with gold and a sulfur sensitizer, and further, as red-sensitive sensitizing dyes, anhydrous 9-ethyl-3,3'-di-(3-sulfopropyl)-4,5,4',5'-dibenzothiacarbocyanine hydroxide, anhydrous 5,5'-dichloro-9-ethyl-3,3'-di-(3-sulfopropyl)thiocarbocyanine hydroxide and anhydrous 5,5'-dichloro-3',9-diethyl-3-(4-sulfobutyl)oxythiacarbocyanine hydroxide were added, followed by addition of 0.25 g of 4-hydroxy-6-methyl-1,3,3a,7-tetrazaindene and 0.01 g of 1-phenyl-5-mercapto-tetrazole; subsequently 400 ml of a dispersion (COP-1) shown below was added to 1 kg of this emulsion, and the mixture was applied so as to give a silver quantity of 1.0 g/m$^2$.

Layer 4: Intermediate layer comprising gelatin containing 2,5-di-tert-octylhydroquinone (dried film thickness 0.5 μm).

Layer 5: Red-sensitive medium sensitivity silver halide emulsion layer: an emulsion as shown in Table 4-2 (containing 0.25 mol of silver halide and 25 g of gelatin per 1 kg) was chemically sensitized similarly as the above emulsion, and further 100 ml of a dispersion (COP-2) shown below was added to 1 kg of this emulsion, and the mixture was applied so as to give a silver quantity of 1.8 g/m$^2$.

Layer 6: Red-sensitive high sensitivity silver halide emulsion layer: an emulsion as shown in Table 4-3 (containing 0.25 mol of silver halide and 30 g of gelatin per 1 kg) was chemically sensitized similarly as the above emulsion, and further 80 ml of a dispersion (COP-3) shown below was added to 1 kg of this emulsion, and the mixture was applied so as to give a silver quantity of 2.0 g/m$^2$.

Layer 7: Intermediate layer comprising gelatin containing 2,5-di-tert-octylhydroquinone (dried film thickness 0.8 μm).

Layer 8: Green-sensitive low sensitivity silver halide emulsion layer: an emulsion as shown in Table 4-1 (containing 0.25 mol of silver halide and 20 g of gelatin per 1 kg) is prepared in a conventional method. 1 kg of this emulsion is chemically sensitized with gold and a sulfur sensitizer, and further, as green-sensitive sensitizing dye, anhydrous 5,5'-dichloro-9-ethyl-3,3'-di-(3-sulfopropyl)oxacarbocyanine hydroxide, anhydrous 5,5'-diphenyl-9-ethyl-3,3'-di-(3-sulfopropyl)oxacarbocyanine, anhydrous 9-ethyl-3,3'-di-(3-sulfopropyl)-5,6,5',6'-dibenzoxacarbocyanine hydroxide were added, followed by addition of 0.25 g of 4-hydroxy-6-methyl-1,3,3a,7-tetrazaindene and 0.01 g of 1-phenyl-5-mercaptotetrazole; subsequently 350 ml of a dispersion (COP-4) shown below was added to 1 kg of this emulsion, and the mixture was applied so as to give a silver quantity of 0.8 g/m$^2$.

Layer 9: The same as the Layer 4.

Layer 10: Green-sensitive medium sensitivity silver halide emulsion layer: an emulsion as shown in Table 4-2 (containing 0.25 mol of silver halide and 20 g of gelatin per 1 kg) was chemically sensitized similarly as the above green-sensitive low sensitivity silver halide emulsion, and further 120 ml of a dispersion (COP-5) shown below was added to 1 kg of this emulsion, to prepare a green-sensitive medium sensitivity silver halide emulsion, which was applied so as to give a silver quantity of 1.8 g/m$^2$.

Layer 11: Green-sensitive high sensitivity silver halide emulsion layer: an emulsion as shown in Table 4-3 (containing 0.25 mol of silver halide and 30 g of gelatin per 1 kg) was chemically sensitized similarly as the above emulsion, and further 60 ml of a dispersion (COP-6) shown below was added to 1 kg of this emulsion, to prepare a green-sensitive high sensitivity silver halide emulsion, which was applied so as to give a silver quantity of 1.8 g/m$^2$.

Layer 12: Intermediate layer comprising gelatin (dried film thickness of 0.5 μm).

Layer 13: Gelatin layer containing yellow colloid silver and 2,5-di-tert-octylhydroquinone (dried film thickness 0.8 μm).

Layer 14: Blue-sensitive low sensitivity silver halide emulsion layer: an emulsion as shown in Table 4-2 (containing 0.25 mol of silver halide and 70 g of gelatin per 1 kg) was chemically sensitized, and to 1 kg of this emulsion was added 1200 ml of a dispersion (COP-7) shown below, and the resultant emulsion was applied so as to give a silver quantity of 0.5 g/m$^2$.

Layer 15: Blue-sensitive high sensitivity silver halide emulsion layer: an emulsion as shown in Table 4-3 (containing 0.25 mol of silver halide and 45 g of gelatin per 1 kg) was chemically sensitized, and to 1 kg of this emulsion was added 200 ml of a dispersion (COP-7) shown below, and the resultant emulsion was applied so as to give a silver quantity of 1.1 g/m$^2$.

Layer 16: First protective layer: Gelatin layer containing UV-absorber and fine grains of silver halide emulsion (the same as in Example 1, amount of coating 0.15 g/m$^2$) (dried film thickness 1.0 μm).

Layer 17: Second protective layer: Gelatin layer containing a matte agent (dried film thickness 0.5 μm).

In respective layers, in addition to the above compositions, gelatin hardeners or surfactants were added.

The dispersions employed in Example 3 are as described below.

Dispersion (COP-1):

A solution of 18 g of a coupler (C-2) and 0.8 g of a coupler (CC-1) dissolved in a mixture of 18.8 g of dioctyl phthalate and 62 ml of ethyl acetate was added into 310 ml of a 5% aqueous gelatin solution containing 1.0 g of sodium triisopropylnaphthalene sulfonate, and the mixture was emulsified in a colloid mill to be prepared to 400 ml.

Dispersion (COP-2):

A solution of 2.5 g of a coupler (C-2), 1.0 g of a coupler (CC-1) and 0.3 g of a DIR compound (exemplary compound (5)) dissolved in a mixture of 4.0 g of dioctyl phthalate and 14 ml of ethyl acetate was added into 70 ml of an aqueous 5% gelatin solution containing 0.2 g of sodium triisopropylnaphthalene sulfonate, and the mixture was emulsified in a colloid mill to be prepared to 100 ml.

Dispersion (COP-3):

A solution of 1.5 g of a coupler (C-3), 0.5 g of a coupler (C-4) and 0.2 g of a DIR compound (exemplary compound (5)) dissolved in a mixture of 9.0 g of tricresyl phosphate and 8 ml of ethyl acetate was added into 62 ml of an aqueous 5% gelatin solution containing 0.2 g of sodium triisopropylnaphthalene sulfonate, and the mixture was emulsified in a colloid mill to be prepared to 80 ml.

Dispersion (COP-4):

A solution of 10 g of a coupler (M-1), 5.5 g of a coupler (M-2) and 0.2 g of a DIR compound (exemplary compound (5)) dissolved in a mixture of 15 g of tricresylphosphate and 51 ml of ethyl acetate was added into 260 ml of an aqueous 5% gelatin solution containing 1.8 g of sodium triisopropylnaphthalene sulfonate, and the mixture was emulsified in a colloid mill to be prepared to 350 ml.

Dispersion (COP-5):

A solution of 3.4 g of a coupler (M-1), 1.3 g of a colored coupler (CM-1) and 0.1 g of a DIR compound (exemplary compound (5)) dissolved in a mixture of 9.5 g of tricresyl phosphate and 16 ml of ethyl acetate was added into 95 ml of an aqueous 5% gelatin solution containing 1.1 g of sodium triisopropylnaphthalene sulfonate, and the mixture was emulsified in a colloid mill to be prepared to 120 ml.

Dispersion (COP-6):

A solution of 1.0 g of a coupler (M-1), 0.8 g of (M-2), 0.3 g of a colored coupler (CM-1) and 0.1 g of a DIR compound (exemplary compound (5)) dissolved in a mixture of 5.0 g of tricresyl phosphate and 6.5 ml of ethyl acetate was added into 45 ml of an aqueous 5% gelatin solution containing 0.5 g of sodium triisopropylnaphthalene sulfonate, and the mixture was emulsified in a colloid mill to be prepared to 60 ml.

Dispersion (COP-7):

A solution of 60 g of a coupler (Y-1) dissolved in a mixture of 24 g of tricresyl phosphate and 20 ml of ethyl acetate was added into 900 ml of an aqueous 5% gelatin solution containing 3.0 g of sodium triisopropylnaphthalene sulfonate, and the mixture was emulsified in a colloid mill to be prepared to 1200 ml.

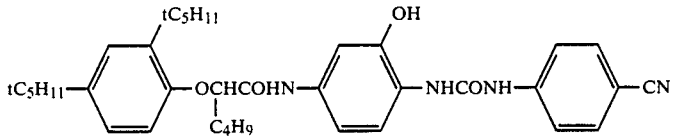

(C-2)

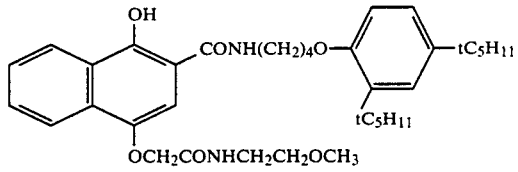

(C-3)

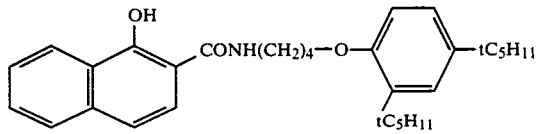

(C-4)

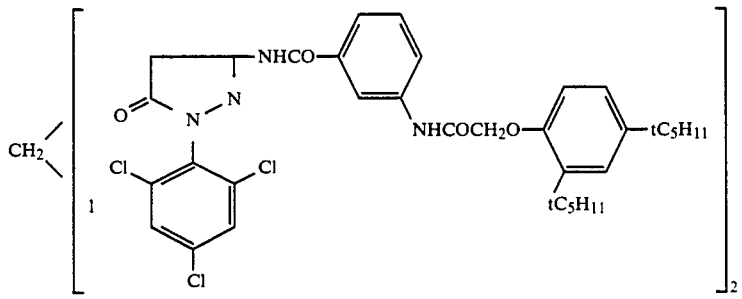

(M-2)

TABLE 4-1

| Sample No. | $\bar{r}$ (μm) | s/$\bar{r}$ (%)*4 | Core composition Br:I | Shell composition Br:I | Core volume (%) | Grain shape |
|---|---|---|---|---|---|---|
| | | | Silver halide emulsions in Layers 3 and 8 | | | |
| 16 (Control) | 0.35 | 48 | Average AgI content:6 mole % | | | Twin |
| 17 (The invention) | 0.55 | 91 | 90:10 | 98:2 | 50 | Tetradecahedral |
| 18 (The invention) | 0.55 | 91 | 90:10 | 98:2 | 50 | Tetradecahedral |
| 19 (The invention) | 0.55 | 91 | 90:10 | 98:2 | 50 | Tetradecahedral |
| 20 (The invention) | 0.60 | 73 | 90:10 | 98:2 | 50 | Twin |
| 21 (The invention) | 0.60 | 87 | 93:7*1 | 100:0*2 | 15*3 | Octahedral (host crystal) |

*1Halogen composition of host crystal for epitaxial type crystal
*2Halogen composition of the epitaxial growth portion for epitaxial type crystal.
*3Volume of the epitaxial growth portion of epitaxial type crystal (%)
*4s/$\bar{r}$ (%):Weight of grains within the range of ±20% of $\bar{r}$.

TABLE 4-2

| Sample No. | $\bar{r}$ (μm) | s/$\bar{r}$ (%)*4 | Core composition Br:I | Shell composition Br:I | Core volume (%) | Grain shape |
|---|---|---|---|---|---|---|
| | | | Silver halide emulsions in Layers 5, 10 and 14 | | | |
| 16 (Control) | 0.65 | 47 | Average AgI content:6 mole % | | | Twin |
| 17 (The invention) | 0.90 | 89 | 90:10 | 98:2 | 50 | Tetradecahedral |
| 18 (The invention) | 0.90 | 89 | 90:10 | 98:2 | 50 | Tetradecahedral |
| 19 (The invention) | 0.90 | 89 | 90:10 | 98:2 | 50 | Tetradecahedral |
| 20 (The invention) | 0.80 | 71 | 90:10 | 98:2 | 50 | Twin |
| 21 (The invention) | 0.80 | 80 | 93:7*1 | 100:0*2 | 15*3 | Octahedral (host crystal) |

*1Halogen composition of host crystal for epitaxial type crystal
*2Halogen composition of the epitaxial growth portion for epitaxial type crystal.
*3Volume of the epitaxial growth portion of epitaxial type crystal (%)
*4s/$\bar{r}$ (%):Weight of grains within the range of ±20% of $\bar{r}$.

TABLE 4-3

| Sample No. | $\bar{r}$ (μm) | s/$\bar{r}$ (%)*4 | Aspect ratio | Composition of the central portion Br:I | Composition of the outside portion Br:I | Volume of the central portion (%) |
|---|---|---|---|---|---|---|
| | | | Silver halide emulsions in Layers 6, 11 and 15 | | | |
| 16 (Control) | 4.8 | 39 | 15:1 | 93:7 | 100:0*2 | 10*3 |
| 17 (The invention) | 4.8 | 39 | 15:1 | 93:7*1 | 100:0*2 | 10*3 |
| 18 (The invention) | 3.5 | 35 | 8:1 | 90:10 | 98:2 | 60 |
| 19 (The invention) | 4.8 | 39 | 15:1 | 93:7*1 | 99:1*2 | 10*3 |
| 20 (The invention) | 4.8 | 39 | 15:1 | 93:7*1 | 99:1*2 | 10*3 |
| 21 (The invention) | 4.8 | 39 | 15:1 | 93:7*1 | 99:1*2 | 10*3 |

*1Halogen composition of host crystal for epitaxial type crystal
*2Halogen composition of the epitaxial growth portion for epitaxial type crystal.
*3Volume of the epitaxial growth portion of epitaxial type crystal (%)
*4s/$\bar{r}$ (%):Weight of grains within the range of ±20% of $\bar{r}$.

Sample 22

As Sample 22, was prepared a sample same as Sample No. 19 except that the silver halide emulsion in Layer 15 thereof comprises poly-dispersed twin crystal emulsion having an average aspect ratio of 4:1, s√r of 40%, an average grain size of 2.7 μm and an average silver iodide content of 5 mol %.

Sample 23

As Sample 23, was prepared a sample same as Sample 19 except that the silver halide emulsion in Layer 14 thereof comprises the emulsion employed in Layer 5, 10 or 14 of Sample 16.

Sample 24

As Sample 24, was prepared a sample same as Sample 21 except that the silver halide emulsion in Layer 15 thereof comprises the emulsion employed in Layer 15 of Sample 22 and the silver halide emulsion in Layer 14 thereof comprises the emulsion employed in Layer 14 of Sample 23.

The sample Nos. 16 to 24 were evaluated according to the same exposure and development as in Example 1. The results are shown in Table 5.

TABLE 5

| Sample No. | Color reproducibility (Interimage effect) $\gamma_{SB}/\gamma_{NB}$ | $\gamma_{SG}/\gamma_{NG}$ | $\gamma_{SR}/\gamma_{NR}$ | Sharpness (MTF relative value) B | G | R |
|---|---|---|---|---|---|---|
| 16 (Control) | 1.05 | 1.05 | 1.06 | 95 | 88 | 85 |
| 17 (The invention) | 1.26 | 1.32 | 1.29 | 112 | 124 | 114 |
| 18 (The invention) | 1.12 | 1.14 | 1.18 | 106 | 114 | 108 |
| 19 (The invention) | 1.24 | 1.35 | 1.25 | 114 | 120 | 116 |
| 20 (The invention) | 1.27 | 1.30 | 1.27 | 113 | 126 | 118 |
| 21 (The invention) | 1.32 | 1.39 | 1.32 | 120 | 135 | 120 |
| 22 (The invention) | 1.20 | 1.30 | 1.25 | 110 | 116 | 112 |
| 23 (The invention) | 1.15 | 1.33 | 1.25 | 110 | 115 | 110 |
| 24 (The invention) | 1.25 | 1.39 | 1.32 | 115 | 130 | 116 |

As can be seen from Table 5, by combined use of the silver halide emulsions of the present invention, marked improvements effects could be recognized with respect to sharpness and color reproducibility.

Also the effects of the present invention are particularly great when an emulsion comprising epitaxial type flat plane grains is employed in the high sensitivity layer.

(Effect of the invention)

According to the present invention, it is possible to obtain a light-sensitive silver halide color photographic material having sensitivity, which is also improved in color reproducibility and sharpness.

What is claimed is:

1. In a light-sensitive silver halide photographic material having blue-sensitive, green-sensitive and red-sensitive photosensitive layers on a support and being capable of forming a multi-color image, the improvement wherein at least one of said photosensitive layers comprises a high sensitivity layer and a low sensitivity layer; at least one of said high sensitivity layers contains flat plate silver halide grains with an average aspect ratio of 5:1 or higher; and at least one of said low sensitivity layers contains an emulsion comprising silver halide grains which are substantially mono-dispersed, said mono-dispersed grains have a grain size within the range of ±20% of the average grain size in an amount of 60% by weight or more based on the total amount of silver halide grains.

2. The light-sensitive silver halide photographic material according to claim 1, wherein said flat plate silver halide grains have an average aspect ratio of from 5:1 to 100:1.

3. The light-sensitive silver halide photographic material according to claim 2, wherein said flat plate silver halide grains have an average aspect ratio of from 5:1 to 20:1.

4. The light-sensitive silver halide photographic material according to claim 1, wherein said flat plate silver halide grains have an average grain size of 0.5 to 15.0 μm.

5. The light-sensitive silver halide photographic material according to claim 1, wherein said flat plate silver halide grains are contained in an amount of 40% by weight or more based on the total amount of silver halide grains contained in the high sensitivity layer.

6. The light-sensitive silver halide photographic material according to claim 1, wherein said flat plate silver halide grains are not subjected to sensitization by epitaxial growth of a different kind of silver salt on their surfaces, and comprise silver iodobromide grains with a content of silver iodide of 0 to 15 mole %.

7. The light-sensitive silver halide photographic material according to claim 6, wherein said flat plate silver iodobromide grains have a central region and an outer region; the iodide content in the outer region being lower than that in the central region.

8. The light-sensitive silver halide photographic material according to claim 1, wherein said flat plate silver halide grains are mono-dispersed ones having a fluctuation coefficient of the grain size distribution of 25% or less.

9. The light-sensitive silver halide photographic material according to claim 1, wherein said flat plate silver halide grains are subjected to sensitization by epitaxial growth of a different kind of silver salt on their surfaces, and the silver halide used for the epitaxial growth is silver bromide.

10. The light-sensitive silver halide photographic material according to claim 9, wherein the proportion of the epitaxial crystals obtained by said epitaxial growth is 5 to 30 mol % based on the total silver halide moles.

11. The light-sensitive silver halide photographic material according to claim 1, wherein the silver halide grains in said low sensitivity layer are core/shell type silver iodobromo grains; the silver iodide contents in the core portion and in the shell portion being 5 to 40 mole % and 5 mole or less, respectively, and the silver iodide content in the shell portion being lower than that in the core portion.

12. The light-sensitive silver halide photographic material according to claim 11, wherein the proportion of the shell portion in the core/shell type silver halide grains is 10 to 80%.

13. The light-sensitive silver halide photographic material according to claim 1, wherein the mono-dispersed silver halide grains in said low sensitivity layer are subjected to sensitization by epitaxial growth of a different kind of silver salt on their surfaces; the silver halide used as the host crystal for the epitaxial growth being silver iodobromide containing 6 to 40 mole % of silver iodide and the silver halide for epitaxial growth being silver iodobromide containing 0 to 5 mole % of silver iodide.

14. The light-sensitive silver halide photographic material according to claim 13, wherein the proportion of the epitaxial crystal portion obtained by the epitaxial growth is 5 to 30 mole % based on the total silver halide moles.

15. The light-sensitive silver halide photographic material according to claim 1, wherein the mono-dispersed silver halide grains in said low sensitivity layer have an average grain size of 0.4 μm or more.

16. The light-sensitive silver halide photographic material according to claim 3, wherein said flat plate silver halide grains have an average grain size of 0.5 to 15.0 μm;

said flat plate silver halide grains are contained in an amount of 40% by weight or more based on the total amount of silver halide grains contained in the high sensitivity layer; and the mono-dispersed silver halide grains in said low sensitivity layer have an average grain size of 0.4 μm or more.

17. The light-sensitive silver halide photographic material according to claim 16 wherein said flat plate silver halide grains are not subjected to sensitization by epitaxial growth of a different kind of silver salt on their surfaces, and comprise silver iodobromide grains with a content of silver iodide of 0 to 15 mole %;

said flat plate silver iodobromide grains have a central region and an outer region; the iodide content in the outer region being lower than that in the central region; and said flat plate silver halide grains are mono-dispersed ones having a fluctuation coefficient of the grain size distribution of 25% or less.

18. The light-sensitive silver halide photographic material according to claim 16 wherein said flat plate silver halide grains are subjected to sensitization by epitaxial growth of a different kind of silver salt on their surfaces, and the silver halide used for the epitaxial growth is silver bromide;

the proportion of the epitaxial crystals obtained by said epitaxial growth is 5 to 30 mole % based on the total silver halide moles;

the mono-dispersed silver halide grains in said low sensitivity layer are subjected to sensitization by epitaxial growth of a different kind of silver salt on their surfaces; the silver halide used as the host crystal for the epitaxial growth being silver iodobromide containing 6 to 40 mole % of silver iodide and the silver halide for epitaxial growth being silver iodobromide containing 0 to 5 mole % of silver iodide; and the proportion of the epitaxial crystal portion obtained by the epitaxial growth is 5 to 30 mole % based on the total silver halide moles.

19. The light-sensitive silver halide photographic material according to claim 17 wherein the silver halide grains in said low sensitivity layer are core/shell type silver iodobromo grains; the silver iodide contents in the core portion and in the shell portion being 5 to 40 mole % and 5 mole % or less, respectively, and the silver iodide content in the shell portion being lower than that in the core portion; and the proportion of the shell portion in the core/shell type silver halide grains is 10 to 80%.

20. The light-sensitive silver halide photographic material according to claim 17 wherein said mono-dispersed grains have a grain size within the range of ±20% of the average grain size in an amount of 70% by weight or more based on the total amount of silver halide grains;

said flat plate silver halide grains have an average grain size of 1.0 to 10.0 μm;

said flat plate silver halide grains are not subjected to sensitization by epitaxial growth of a different kind of silver salt on their surfaces, and comprise silver iodobromide grains with a content of silver iodide of 4 to 10 mole %; and the mono-dispersed silver halide grains in said low sensitivity layer have an average grain size of 0.6 to 2.0 μm or more.

21. The light-sensitive silver halide photographic material according to claim 18 wherein said mono-dispersed grains have a grain size within the range of ±20% of the average grain size in an amount of 70% by weight or more based on the total amount of silver halide grains;

said flat plate silver halide grains have a average grain size of 1.0 to 10.0 μm;

wherein said silver iodobromide used as the host crystal contains from 7 to 20 mole % silver iodide and the silver iodobromide used for epitaxial growth contains 0.4 mole % of silver iodide; and the mono-dispersed silver halide grains in said low sensitivity layer have an average grain size of 0.6 to 2.0 μm or more.

* * * * *